US006633033B2

(12) United States Patent
Yoshinari et al.

(10) Patent No.: US 6,633,033 B2
(45) Date of Patent: Oct. 14, 2003

(54) APPARATUS FOR MASS SPECTROMETRY ON AN ION-TRAP METHOD

(75) Inventors: Kiyomi Yoshinari, Hitachi (JP); Yoshiaki Kato, Mito (JP); Katsuhiro Nakagawa, Hitachiohta (JP); Shinji Nagai, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 165 days.

(21) Appl. No.: 09/730,935

(22) Filed: Dec. 6, 2000

(65) Prior Publication Data

US 2002/0008199 A1 Jan. 24, 2002

(30) Foreign Application Priority Data

Dec. 7, 1999 (JP) ..... 11-347412

(51) Int. Cl.[7] ..... H01J 49/42
(52) U.S. Cl. ..... 250/292; 250/281; 250/286
(58) Field of Search ..... 250/292, 282, 250/281, 286

(56) References Cited

U.S. PATENT DOCUMENTS

| | | | | | |
|---|---|---|---|---|---|
| 4,761,545 | A | | 8/1988 | Marshall et al. | 250/291 |
| 5,134,286 | A | | 7/1992 | Kelley | 250/282 |
| 5,248,882 | A | * | 9/1993 | Liang | 250/29 |
| 5,679,951 | A | * | 10/1997 | Kelley et al. | 250/282 |
| 6,075,244 | A | * | 6/2000 | Baba et al. | 250/292 |

FOREIGN PATENT DOCUMENTS

| | | |
|---|---|---|
| WO | WO 94/04252 | 3/1994 |

* cited by examiner

*Primary Examiner*—Nikita Wells
(74) *Attorney, Agent, or Firm*—Kenyon & Kenyon

(57) ABSTRACT

Depending on the RF driving voltage amplitude value and the frequency of each frequency component of wideband auxiliary AC voltages, the wideband auxiliary AC voltage comprising plural different frequency components is optimized so that undesired ions having mass-to-charge ratios within the required range will be resonantly ejected from the ion trap electrodes.

16 Claims, 22 Drawing Sheets

$R_{fnf}$ : UNDESIRED ION RELEASE EFFICIENCY
$\Delta M_{min}$ : RESOLUTION AT THE LOWER-MASS-NUMBER SIDE [amu]
$\Delta M_{max}$ : RESOLUTION AT THE HIGHER-MASS-NUMBER SIDE [amu]

$R_{fnf}$ : UNDESIRED ION RELEASE EFFICIENCY
$\Delta M_{min}$ : RESOLUTION AT THE LOWER-MASS-NUMBER SIDE [amu]
$\Delta M_{max}$ : RESOLUTION AT THE HIGHER-MASS-NUMBER SIDE [amu]

$R_{fnf}$ : UNDESIRED ION RELEASE EFFICIENCY
$\Delta M_{min}$ : RESOLUTION AT THE LOWER-MASS-NUMBER SIDE [amu]

APPARATUS FOR MASS SPECTROMETRY ON AN ION-TRAP METHOD

BACKGROUND OF THE INVENTION

The present invention relates to an ion trap type mass spectrometer by which wideband auxiliary AC electric fields having the frequency components within the required range are created, then ions having mass-to-charge ratios within the required range are ejected by resonance, and only specific species of ions are analyzed at high sensitivity and high resolution, or only specific species of dissociated ions are analyzed using the tandem mass (MS/MS) method.

The corresponding ion trap type mass spectrometer, as shown in FIG. 2, consists of ring electrode 10 and end cap electrodes 11 and 12 arranged vertically facing one another so as for the ring electrode to be located in between. Hereinafter, the ring electrode and the end cap electrodes are collectively referred to as the ion trap electrodes. Quadruple-pole electric fields are generated in the space between the electrodes by the application of a direct-current (DC) voltage, U, and a radio-frequency (RF) driving voltage $V_{RF}$COSΩt, between the electrodes. The stability of the oscillation of the ions that have been trapped in these fields is dictated by the values "a" and "q" in expression (1) below that are given by the size of the apparatus (namely, inner radius "$r_0$" of the ring electrode), the DC voltage, U, applied to each electrode, the amplitude, V, and the angular frequency, Ω, of the RF driving voltage, and the mass-to-charge ratio, "m/z" (kg/coulomb), of the ion.

$$a = \frac{8eU}{r_0^2\Omega^2} \cdot \frac{z}{m},\ q = \frac{4eV_{RF}}{r_0^2\Omega^2} \cdot \frac{z}{m} \tag{1}$$

In the above expression, "z", "m", and "e" denote the valence number, mass, and elementary charge, respectively, of the ion. The stability region denoting the range of "a" and "q" in which stability of ion oscillation is given in the ion trap inter-electrode space is shown in FIG. 3.

Since only RF driving voltage $V_{RF}$COSΩt is applied to the ring electrode, all ions equivalent to the line of "a=0" in the stability region are usually oscillated in the space and trapped between the electrodes. At this time, the point of (0, q) on the stability region differs according to the particular mass-to-charge ratio "m/z" of the ion, and each ion is arranged "a" -axially between "q=0" and "q=0.908" on the line of "a=0" in order of the magnitude of the mass-to-charge ratio, subject to expression (1) above.

In the ion trap type mass spectrometer, therefore, all species of ions whose mass-to-charge ratios fall within a certain range are stably pre-trapped, at which time, the ions oscillate at a different frequency, depending on the "m/z" value. This characteristic is utilized for auxiliary AC electric fields of a specific frequency to be superimposed in the ion trap inter-electrode space, and only the ions that resonate with the auxiliary AC electric field therewith undergo mass separation.

Of all ions in the specimen, only those to undergo mass separation are sequentially scanned in terms of mass (mass scan analysis) to obtain a mass distribution chart (mass spectral chart) of all ingredients in the specimen. At this time, the quantity of ions which can be trapped in the ion trap inter-electrode space is realistically limited because increases in the quantity of ions trapped increase the effects of the space charge and thus reduce the analyzing performance of the apparatus.

Therefore, when the mass range ("m/z" range) of undesired ions, or ions not to be analyzed, is known or when the mass range ("m/z" range) of the necessary ions, or the ions to be analyzed, is known, all species of undesired ions can be ejected from the ion trap inter-electrode space before the ions in the specimen undergo mass spectral analysis.

Once all unnecessary ions have been ejected from the specimen, the number of necessary species of ions trapped in the ion trap inter-electrode space will correspondingly increase and thus analytical sensitivity will increase. Also, when only ions of a specific mass number (namely, parent ions) are trapped, dissociated, and undergo tandem mass spectral analysis (MS/MS analysis) to obtain the mass distribution of the dissociated ions, the quantity of parent ions trapped can be increased by ejecting all non-parent ions as undesired ion species. In addition, the creation of dissociated ions from non-parent ions can be avoided.

Since this MS/MS analytical method enables the acquisition of further detailed information on the molecular structure of specific ions, the MS/MS analytical function has come to be among the most important functional requirements of a mass spectrometer in recent years.

Various methods of eliminating all undesired ions whose "m/z" values fall within the required range have been developed up to now. For example, a method of ejecting such ions by applying wideband signals to the ion trap electrodes during the mass spectrographic scanning period is disclosed in U.S. Pat. No. 4,761,545.

Also, methods in which all undesired having their own oscillational frequencies falling outside the specified band are ejected by applying a frequency band-pass filter to noise waveforms are disclosed in U.S. Pat. No. 5,134,286 and Japanese Application Patent Laid-Open Publication No. Hei-7-509097.

In the above-mentioned examples, although the two methods differ in that whether they use a frequency band-pass filter, such a wideband auxiliary AC voltage as shown in expression (2) below, is applied to the ion trap inter-electrode space.

$$V_{FNF} = \sum_{i}^{n} v_i \sin(\omega_i + \phi_i),\ \omega_{i+1} - \omega_i = \Delta\omega \tag{2}$$

Although these methods have heretofore been proposed for phase control between frequency components, since constant values are set for the amplitude, $V_i$, of each frequency component and the angular frequency division width, Δω, between frequency components, no control has been provided as to the wideband auxiliary AC voltage, $V_{FNF}$, or as to the amplitude, $V_i$, of each frequency component or the frequency division width, Δω, between frequency components according to the RF driving voltage value $V_{RF}$.

SUMMARY OF THE INVENTION

Under the prior art, when wideband auxiliary AC voltages having interspaced different frequencies within a frequency range equivalent to the resonance frequency of undesired ions are applied between ion trap electrodes in order to eject these undesired ions resonantly from the ion trap inter-electrode space, constant values are usually set for the auxiliary AC voltage amplitude, Vi, of each frequency component and the frequency division width, Δω, between frequency components.

In the case that wideband auxiliary AC electric fields are generated this way by voltage application, there occurs the problem that even the undesired ions within the specified range are not effectively removed by resonant ejection and remain between the ion trap electrodes.

Other problems also occur. That is to say, because of low resolution in mass separation of undesired ions and the desired ions to be analyzed, the undesired ions whose frequencies are close to those of the desired ions cannot be ejected or the desired ions are ejected along with the undesired ions.

The purpose of the present invention is to supply the ion trap mass spectrometry and ion trap mass spectrometer that enable highly efficient release of undesired ions having a wide range of "m/z" values, and the separation of undesired ions and the desired ions at high resolution.

The present invention for fulfilling the purpose described above relates particularly to an ion trap type mass spectrometer that comprises:

a ring electrode, a pair of end cap electrodes facing one another so as to arrange said ring electrode between said end cap electrodes, a radio-frequency power supply for applying to said ring electrode and said end cap electrodes a radio-frequency voltage that generates a radio-frequency electric field in the space formed between said two types of electrodes, an ion generator for creating ions inside said inter-electrode space or creating ions outside said space and introducing the ions thereinto, a trapper for trapping created ions in said inter-electrode space, an alternating-current (AC) electric field generator for generating in said space a wideband auxiliary AC electric fields of different frequencies within the frequency range required for resonant release only of the ions within the required mass-to-charge ratio range among all created ions, and a detector by which the ions that have been trapped in said space are sequentially separated in terms of mass according to the particular mass-to-charge ratio of the ion and then after the trapped ions have been emitted from the space, the mass of these ions are detected;

wherein the strength of wideband auxiliary AC electric fields comprising the frequency components within the required frequency range mentioned above is varied according to the strength of the radio-frequency electric field generated in the space.

More specifically, the present invention fulfills the aforementioned purpose by: (1) Changing the wideband auxiliary AC voltages of different frequencies within the required frequency range according to the applied RF driving voltage.

(2) Changing the amplitude, Vi, of each frequency component at a wideband auxiliary AC voltages according to the frequency of the frequency component or range of the frequency component at the wideband auxiliary AC voltage.

(3) Changing the frequency division width, $\Delta\omega i$, between the adjoining frequency components of a wideband auxiliary AC voltage according to either the frequency of the frequency component or the "m/z" value of the ion at which the frequency of the frequency component becomes equal to the oscillation frequency of that ion in the ion trap inter-electrode space.

DETAILED DESCRIPTION OF THE PREFERRED EMBODIMENTS

Embodiments of the present invention are described seeing the accompanying drawings.

Embodiment 1

Figure 1:
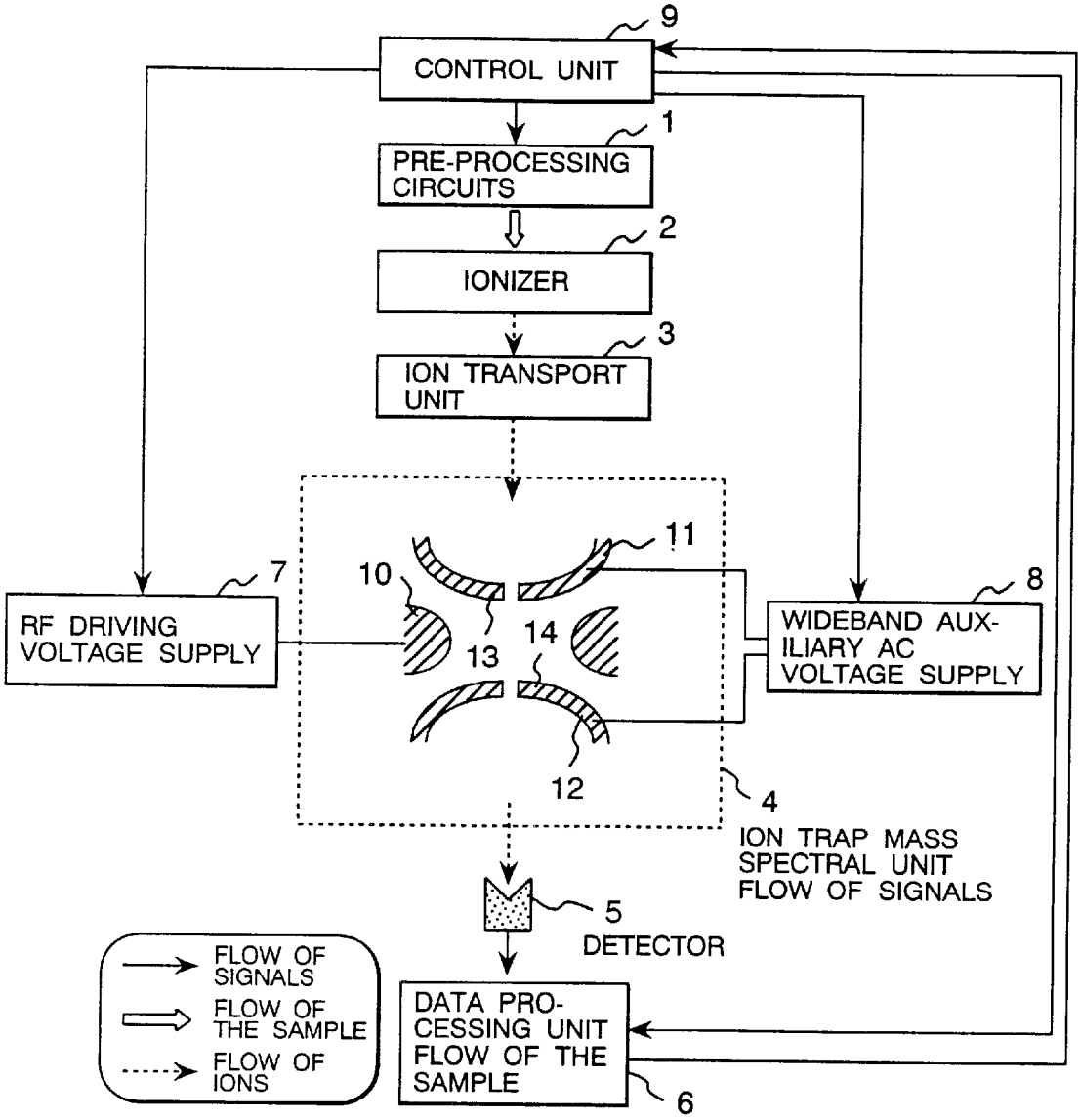
FIG. 1 is a total schematic diagram of the ion trap mass spectrometer, an embodiment of the present invention.
Figure 2:
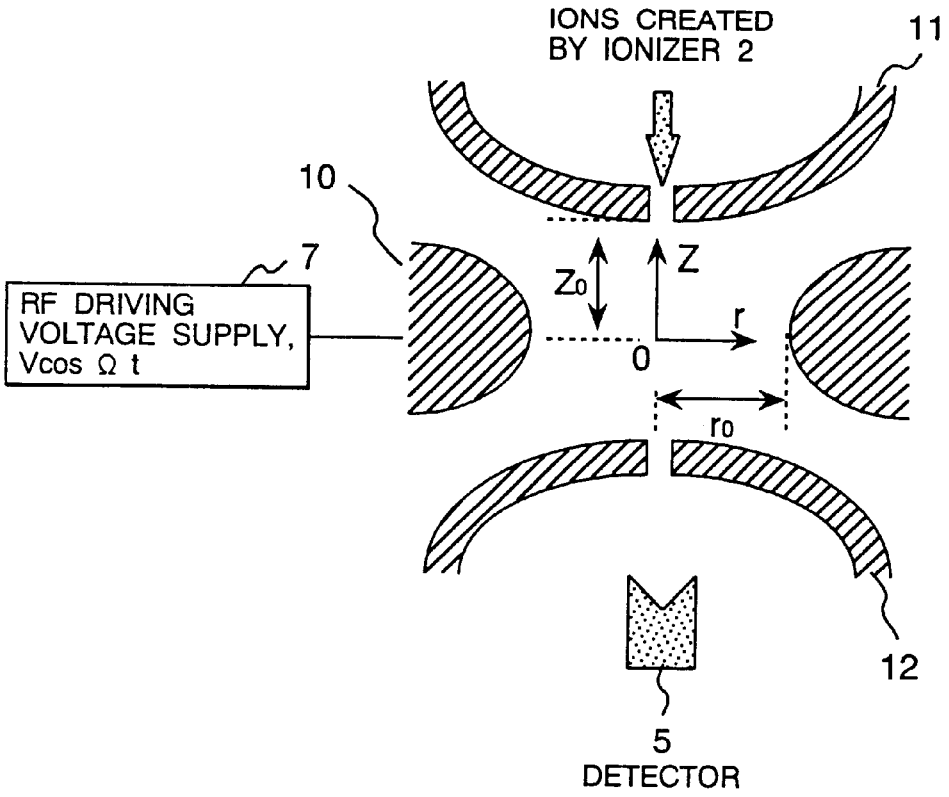
FIG. 2 is an epitomized cross-sectional view of the electrodes of the ion trap unit.
Figure 3:
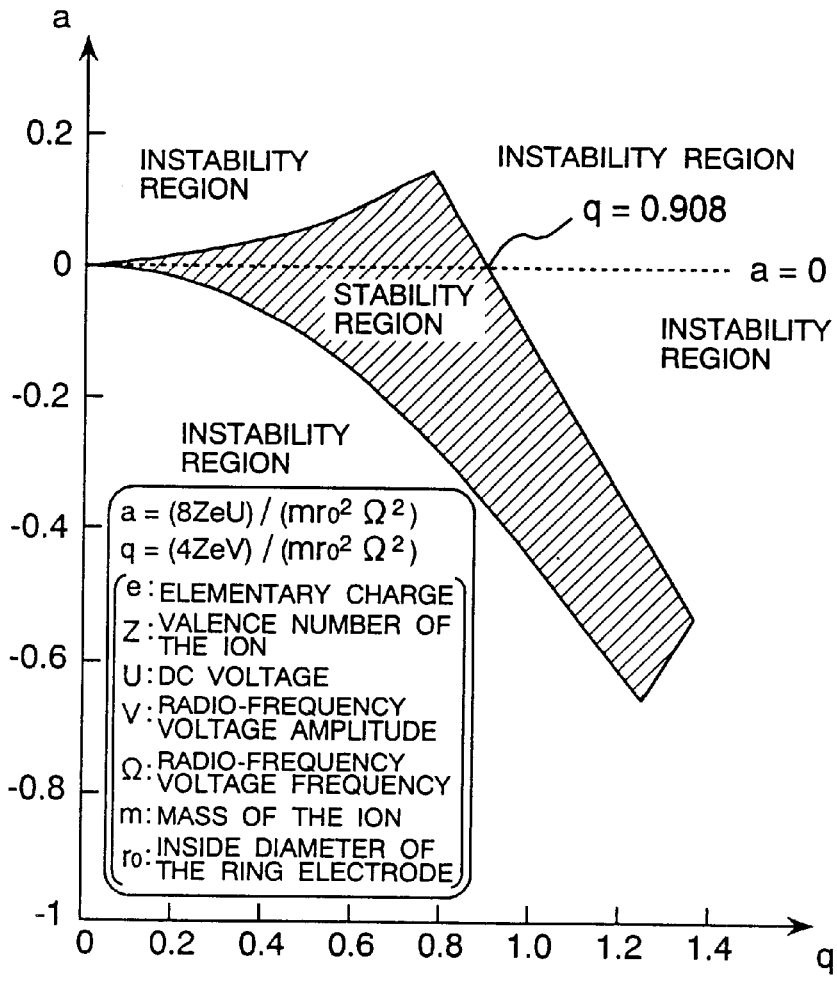
FIG. 3 is a stable region diagram of the "a" and "q" values that dictate the stability of the ion orbits inside the ion trap unit.

A schematic diagram of an ion trap type mass spectrometer based on the present invention is shown as FIG. 1. The components of the sample mixture to undergo mass spectral analysis are separated through pre-processing unit 1 such as a gas chromatograph or liquid chromatograph, and then ionized in ionizer 2.

Ion trap type mass spectral unit 4 is composed of ring electrode 10 and a pair of end cap electrodes 11 and 12 arranged facing one another with the ring electrode in between. Quadruple-pole electric fields are generated in the space by the application of RF driving voltage $V_{RF}COS\Omega t$ from RF driving voltage supply 7 to ring electrode 10.

The ions that have been created in ionizer 2 are passed through ion transport unit 3, then injected into the inter-electrode space (the space between end cap electrodes 11 and 12 through injection port 13 of end cap electrode 11, and stably pre-trapped by the quadruple-pole electric fields. After this, ions having different "m/z" values sequentially undergo mass separation (mass scan analysis).

There are two major methods of aforementioned mass separation. One is the mass selective instability method, wherein the trajectories of specific ion species are made unstable by adjusting the RF driving voltage $V_{RF}COS\Omega t$ supplied from RF driving voltage supply 7 to ring electrode 10 and then the required ions are emitted from the inter-electrode space after undergoing mass separation.

The other method is resonant emission, wherein specific species of ions undergo mass separation by resonant amplification using the auxiliary AC electric field generated by applying an auxiliary AC voltage of a single frequency from wideband auxiliary AC voltage supply 8 to the space between end cap electrodes 11 and 12.

The ions, after undergoing mass spectral analysis with these methods, are emitted from the inter-electrode space according to the particular "m/z" value. Ions that have been passed through emission port 4 of end cap electrode 12 are detected by detector 5 and processed by data processing unit 6.

This entire series of mass spectral analytical processes, namely, "ionizing the specimen, transporting the specimen ion beams to and injecting them into ion trap type mass spectral unit 4, adjusting the RF driving voltage amplitude during sample ion injection, sweeping the RF driving voltage amplitude (sweeping the "m/z" value of each ion to undergo mass spectral analysis), adjusting the amplitudes, types, and timing of auxiliary AC voltages and detecting ions and processing the data thus obtained are controlled by control unit 9.

In this embodiment, in addition to the above series of mass spectral analytical processes, when among all sample ions, only those which are not to be analyzed (namely, undesired ions) or only those to be analyzed (namely, the desired ions) have their mass ranges ("m/z" ranges) known beforehand, the mass ranges ("m/z" ranges) of these undesired ions can be specified and then ejected prior to the start of the mass spectral analysis, only when this ejection function is provided.

The ejection of undesired ions usually goes through these processes: first, the user specifies the mass ranges ("m/z" ranges) of undesired ions and enters these ranges into control unit 9 of a computer or the like; next, the resonance frequencies of each desired ion are calculated from the specified mass ranges ("m/z" ranges) of the undesired ions by control unit 9, then wideband auxiliary AC electric fields are generated between the ion trap electrodes by applying interspaced individual auxiliary AC voltages within that resonance frequency range from wideband auxiliary AC voltage supply 8 to the ion trap inter-electrode space, and thus the undesired ions are resonantly ejected from the ion trap inter-electrode space.

Figure 4A:
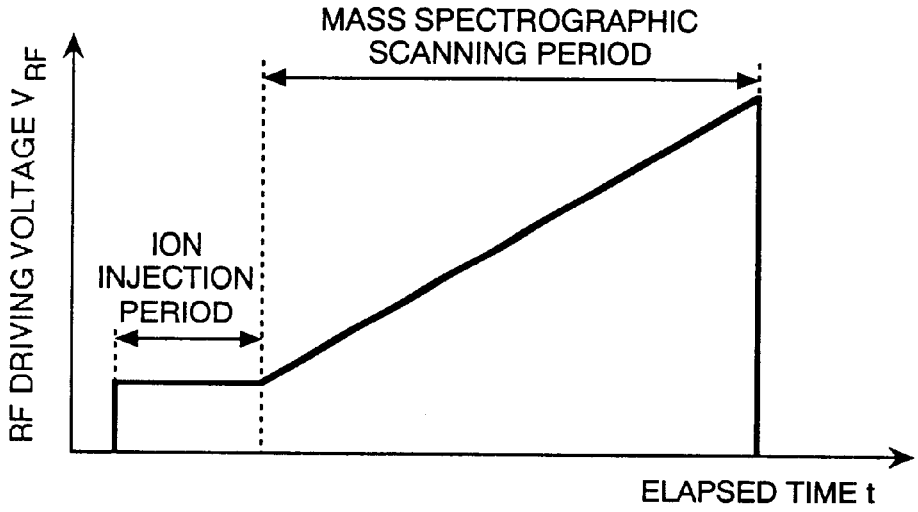
FIG. 4 is a basic sequence diagram of the mass spectrographic processes in the ion trap mass spectrometer.

When ionization occurs in the ion trap inter-electrode space as shown in FIG. 1, the desired ions can also be ejected at the pre-stage of the mass spectral analysis scanning period, that is to say, during the period of sample ion injection into the ion trap inter-electrode space, as shown in FIG. 4*a*. FIG. 4*a* is a basic sequence diagram showing the analytical processes of an ion trap mass spectrometer which uses an external ion generator to ionize ions.

The method of applying wideband auxiliary AC voltages to the ion trap inter-electrode space to ejection undesired ions from it by resonant ejection is described below using FIGS. 5 to 10.

Figure 5:
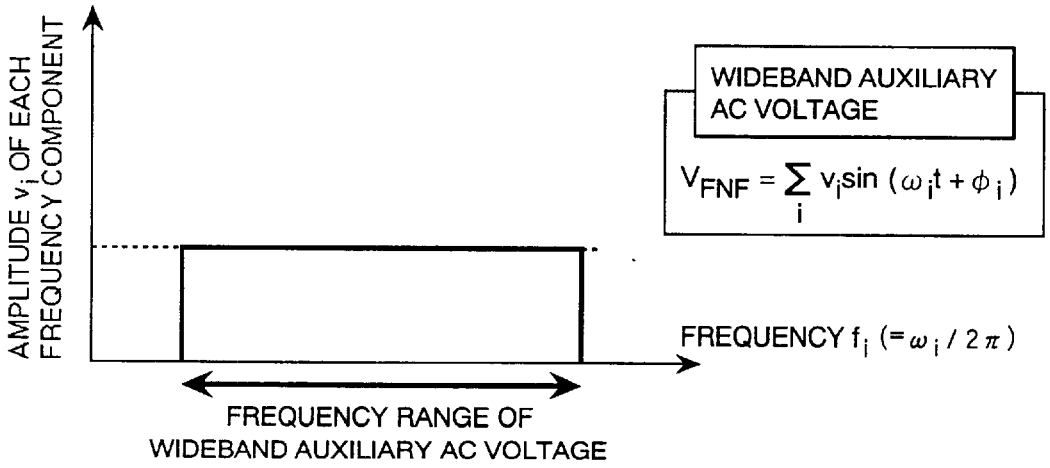
FIG. 5 is a conceptual diagram representing the magnitude of the voltage amplitude with respect to each frequency component at a wideband auxiliary AC voltage.
Figure 6A:
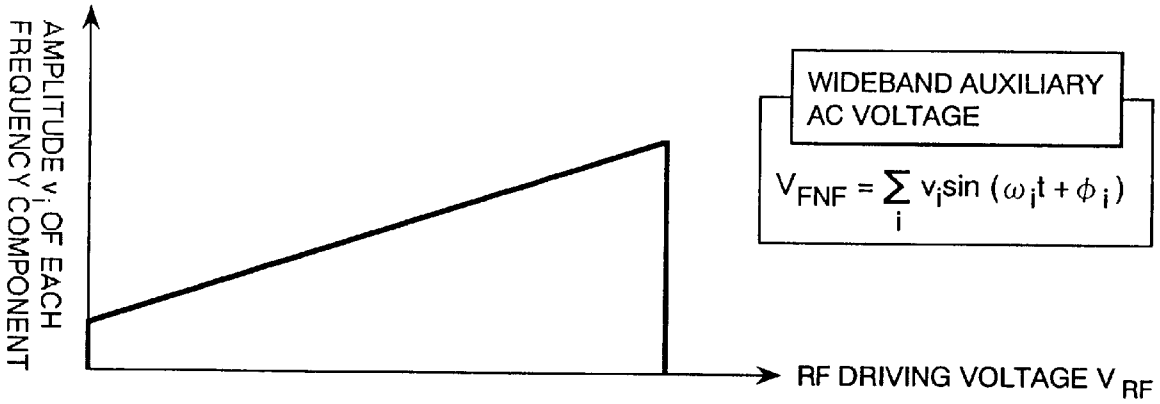
FIG. 6 is a diagram showing the wideband auxiliary AC voltage setting method described in embodiment 1.

In this embodiment, when the voltage amplitude, $v_i$, of each frequency component at a wideband auxiliary AC voltage is set so as to become constant between its frequency components as shown in FIG. 5, the voltage amplitude, vi, of each frequency component is set to a value that has been increased in proportion to the amplitude, $V_{RF}$, of the RF driving voltage, $V_{RF}COS\Omega t$, as shown in FIG. 6*a*. Such setting is effective for maintaining the resonance force to eliminate undesired ions, that is to say, maintaining the resonance amplification force to eliminate the undesired ions, by increasing the strength of the wideband auxiliary AC electric fields in proportion to the magnitude of ion trapping electric fields. Numeric analyses on the effectiveness of the present invention are shown in FIGS. 7 to 9.

FIG. 7 shows the results of the numeric analyses on the maximum oscillation amplitude, $A_{max}$, of the ions within the mass from 600 to 1100 amu when the reserpine ion of 609 amu is chosen as the parent ions and wideband auxiliary AC voltages with a frequency division width of 1 kHz between adjoining frequency components in a frequency range from 150 to 270 kHz are applied between end cap electrodes 11 and 12.

The frequencies of the wideband auxiliary AC voltages that were applied at this time, namely, from 150 to 270 kHz, are equivalent to the resonance frequencies of the ions ranging from 649 to 1012 amu. In other words, ions from 649 to 1012 amu in mass number fall within the mass number range of the ions to be resonantly ejected (hereinafter, this range is referred to as the resonance range).

FIG. 7 also shows to what ion species in terms of resonance frequency each of the frequency components of the wideband auxiliary AC voltages corresponds. Since the resonance frequency and the ion mass number take the relationship of almost reciprocal numbers, ions greater in mass number are lower in resonance frequency, and ions smaller in mass number are higher in resonance frequency. This statement, however, assumes that all ions are univalent positive ions.

Figure 7A:
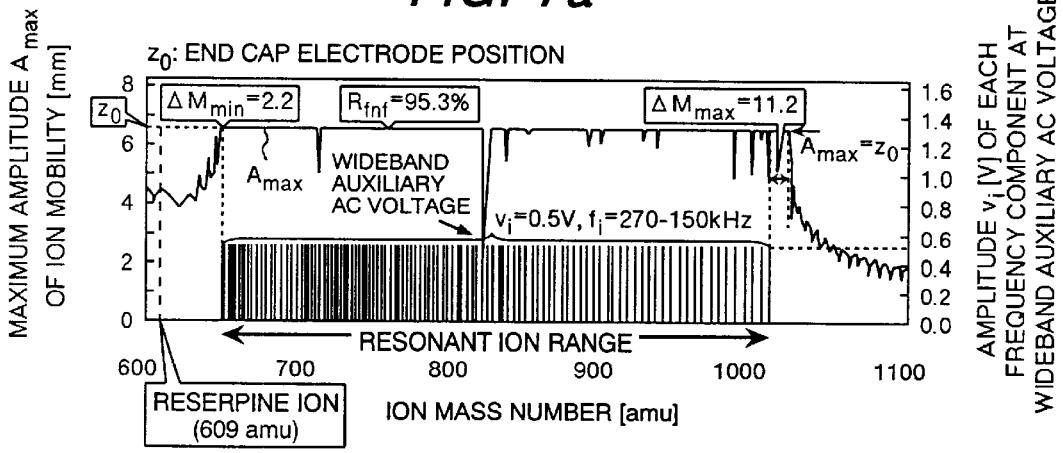
FIG. 7 shows the results of the numeric analyses on the maximum oscillation amplitude value, $A_{max}$, of 200–400 amu ions that was obtained when wideband auxiliary AC voltages were applied at frequencies from 150 to 270 kHz.
Figure 7B:
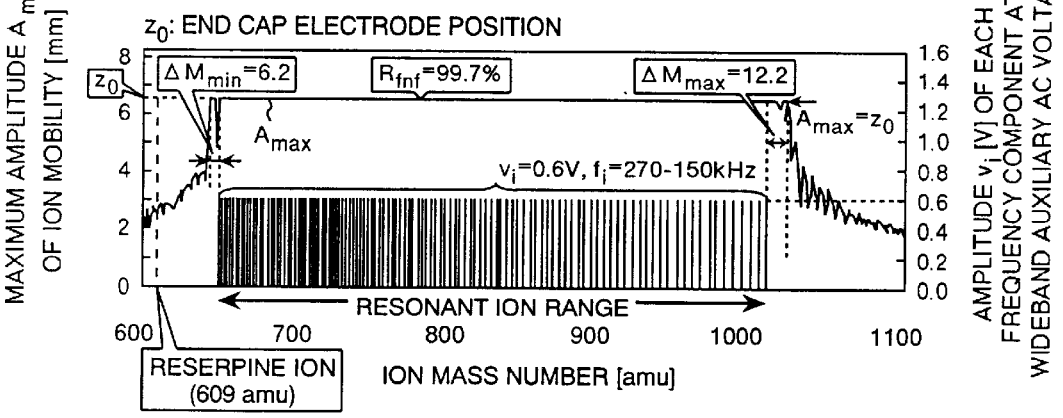
Figure 7C:
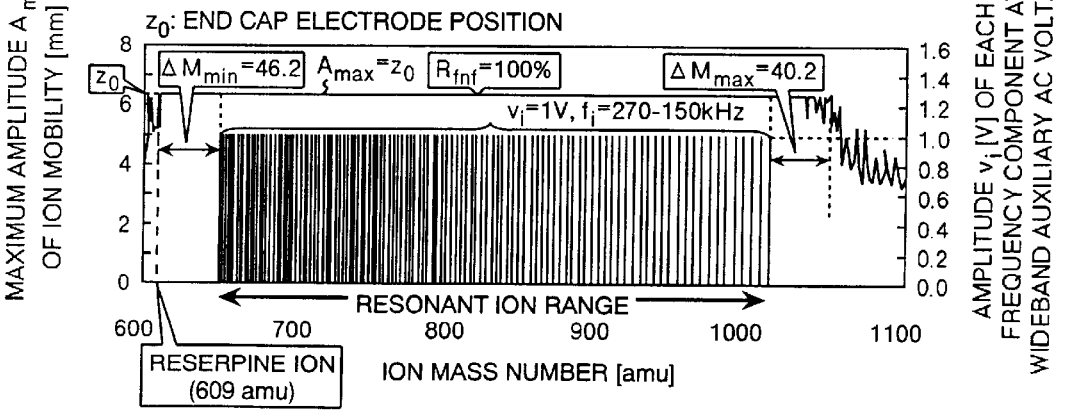

FIGS. 7*a*, 7*b*, and 7*c* show the results of the numeric analyses that were obtained when values of 0.5 V, 0.6 V, and 1.0 V were set as the voltage amplitude, $v_i$, of each frequency component at the wideband auxiliary AC voltages.

In each case, when the maximum oscillation amplitude, Amax, of the ions is reached at an end cap electrode position of $z_0$, the corresponding ions are judged to have been resonantly emitted, and when the maximum oscillation amplitude, $A_{max}$, of the ions is not reached at the end cap electrode position of $z_0$, the corresponding ions are judged to have remained in the ion trap inter-electrode space. These results indicate that the difference of mass number in the minimum range (resolution $\Delta M_{min}$) and the difference of mass number in the maximum range (resolution $\Delta M_{max}$) between the ions that were specified to be ejected, and actually ejected ions (the maximum oscillation amplitude, $A_{max}$, of the ions was reached at the end cap electrode position of $z_0$), are 2.2 amu at the lower-mass-number side and 11.2 amu at the higher-mass-number side, respectively, and thus that the reserpine ions, that is, the parent ions, remain in the ion trap inter-electrode space exactly as specified.

It can also be seen that even for the ions falling within the "m/z" range of the ions whose ejection was specified, in the region of the higher-mass-number side, the maximum amplitude, $A_{max}$, of the ions is not reached at the end cap electrode position of $z_0$, and that as a result, the corresponding ions remain in the ion trap inter-electrode space without being resonantly ejected. The undesired-ion ejection efficiency at this time is 95.3%, and the ions that were not ejected account for 4.7% of all ions whose ejection was specified.

When $V_i$=1 V (see FIG. 7*c*), although all ions within the "m/z" range of the ions whose ejection was specified are ejected, the resolution at the lower-mass-number side that has overstepped the range of resonant ions is very low ($\Delta M_{min}$=46.2 amu) and the parent ions (reserpine ions) to be left inside the ion trap space are also resonantly ejected.

When $V_i$=0.6 V, the ions within almost the same "m/z" range as the specified resonant ion "m/z" range are resonantly ejected at a very high ratio of 99.7% and the reserpine ions are left in the ion trap inter-electrode space without being selectively ejected.

This means that when each voltage of each frequency component of the wideband auxiliary AC voltages is 0.6 V, the undesired ions within the specified "m/z" range are resonantly ejected with high efficiency and that the desired ions and the undesired ions have undergone mass separation at high resolution. Accordingly, it can be seen that a $V_i$ value of 0.6 V is optimal as the voltage of each frequency component at the wideband auxiliary AC voltages in this case.

Similar analyses were performed using different RF driving voltages, $V_{RF}$. First, the results that were obtained when about ⅓ of the RF driving voltage, $V_{RF}$, used in the analytical case of FIG. 7 was applied, are shown in FIG. 8. The wideband auxiliary AC voltages, however, were set to the same values as those set for the frequency range from 150 to 270 kHz and frequency division width of 1 kHz between adjoining frequency components in FIG. 7.

Figure 8A:
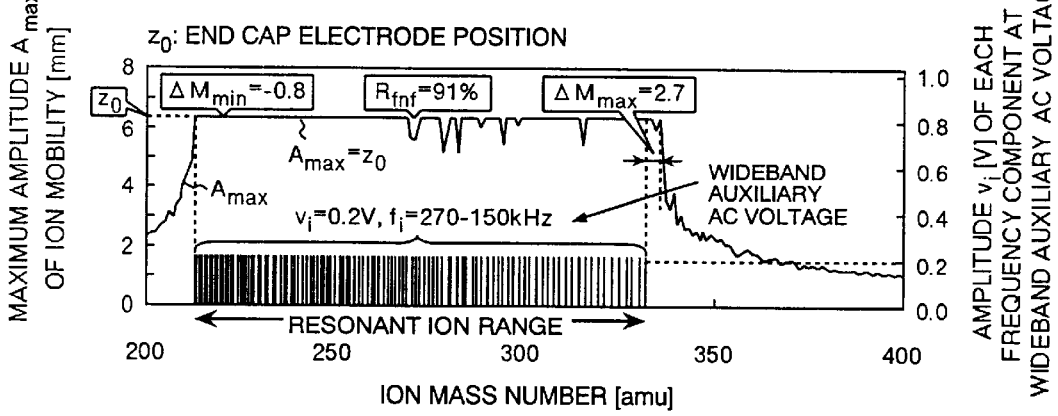
FIG. 8 shows the results of numeric analyses on the maximum oscillation amplitude value, $A_{max}$, of 600–1100 amu ions that was obtained when wideband auxiliary AC voltages were applied at frequencies from 150 to 270 kHz.
Figure 8B:
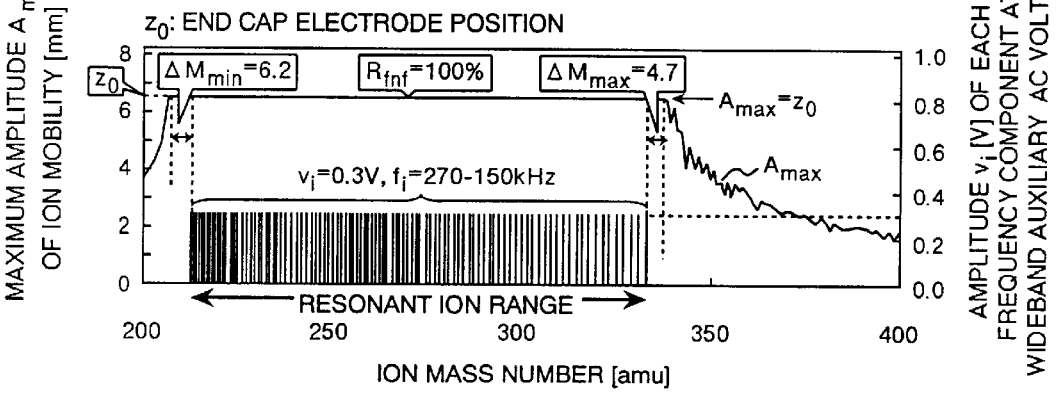
Figure 8C:
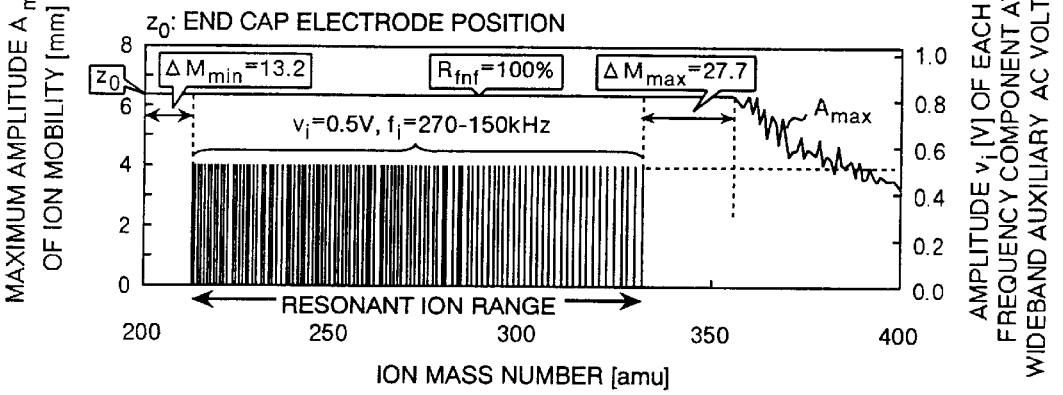

FIGS. 8*a*, 8*b*, and 8*c* show the numeric analyses that were obtained when values of 0.2 V, 0.3 V, and 0.5 V were set as the voltage amplitude, $v_i$, of each frequency component of the wideband auxiliary AC voltages.

Although the "m/z" range of the ions whose resonant ejection was specified is from 213 to 332 amu, when $V_i$=0.2 V, the ejection efficiency for the ions within the mass range of the specified resonant ions is low (91%), and when $V_i$=0.5 V, the corresponding ejection efficiency is 100%. In the latter case, however, ions outside the resonance range are also excessively removed by resonant ejection and resolution $\Delta M$ becomes $\Delta M_{min}$=13.2 amu at the lower-mass-number side, and $\Delta M_{max}$=27.7 amu at the higher-mass-number side.

When $V_i$=0.3 V, the ions within almost the same mass range as that of the mass range of the specified resonant ions are resonantly ejected with an efficiency of 100% ($\Delta M_{min}$=6.2 amu at the lower-mass-number side, and $\Delta M_{max}$=4.7 amu at the higher-mass-number side). Accordingly, a Vi value of 0.3 V is the optimal voltage of each frequency component at the wideband auxiliary AC voltages in this case.

Similarly, when 1.7 times the RF driving voltage, $V_{RF}$, used in the analytical case of FIG. 7 is applied and the wideband auxiliary AC voltages are set to the same values as those set for the frequency range from 150 to 270 kHz and frequency division width of 1 kHz between the adjoining frequency components in FIG. 7, the "m/z" range of the specified resonant ions in this case is from 1118 to 1743 amu.

Figure 9A:
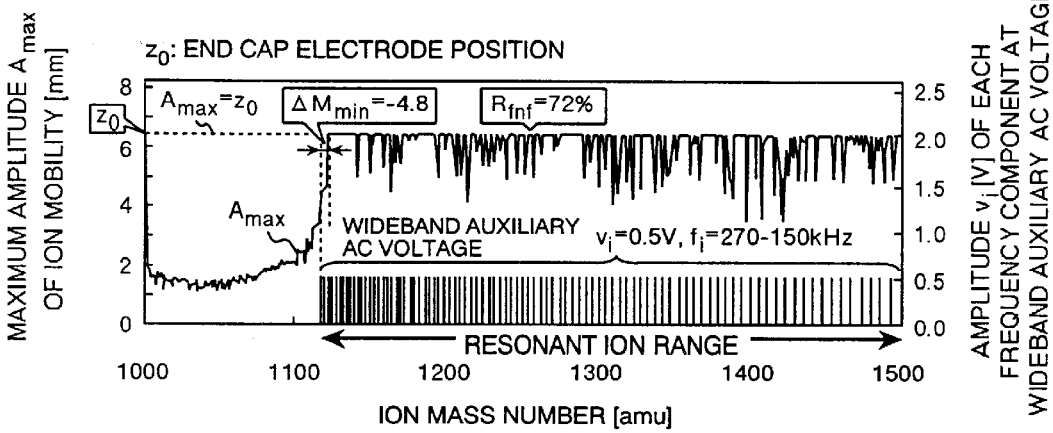
FIG. 9 shows the results of numeric analyses on the maximum oscillation amplitude value, $A_{max}$, of 1000–1500 amu ions that was obtained when wideband auxiliary AC voltages were applied at frequencies from 150 to 270 kHz.
Figure 9B:
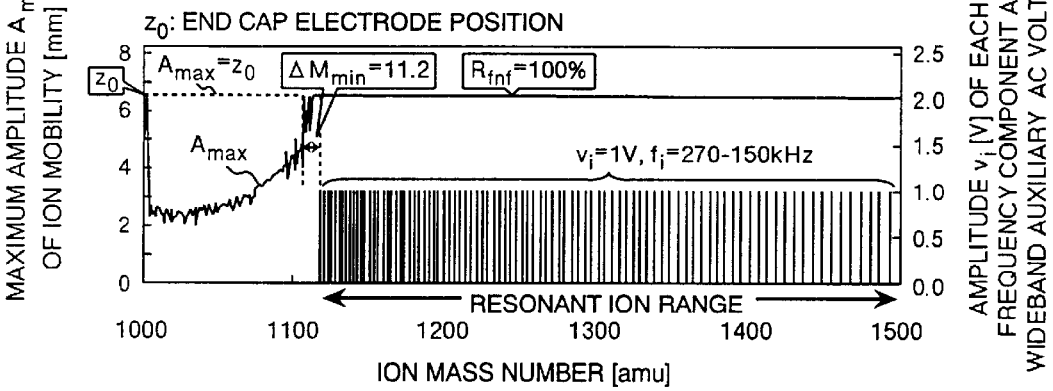
Figure 9C:
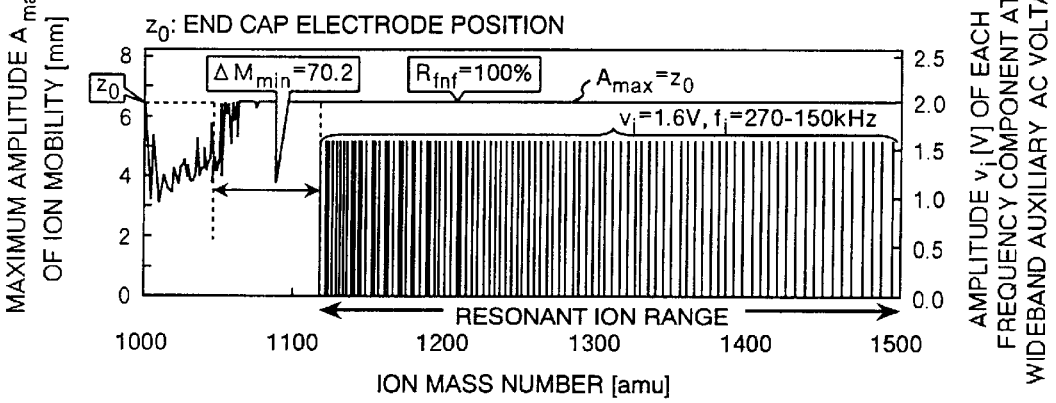

FIGS. 9*a*, 9*b*, and 9*c* show the results of the numeric analyses that were obtained when values of 0.5 V, 1.0 V, and 1.6 V were set as the voltage amplitude, $v_i$, of each frequency component at wideband auxiliary AC voltages.

For the same reasons as in FIGS. 7 and 8, a $V_i$ value of 1.0 V is the optimal voltage of each frequency component at the wideband auxiliary AC voltages in this case. It can therefore be seen that as the driving voltage amplitude value, $V_{RF}$, changes, the optimal voltage amplitude, Vi, of each frequency component at wideband auxiliary AC voltages.

Figure 10:
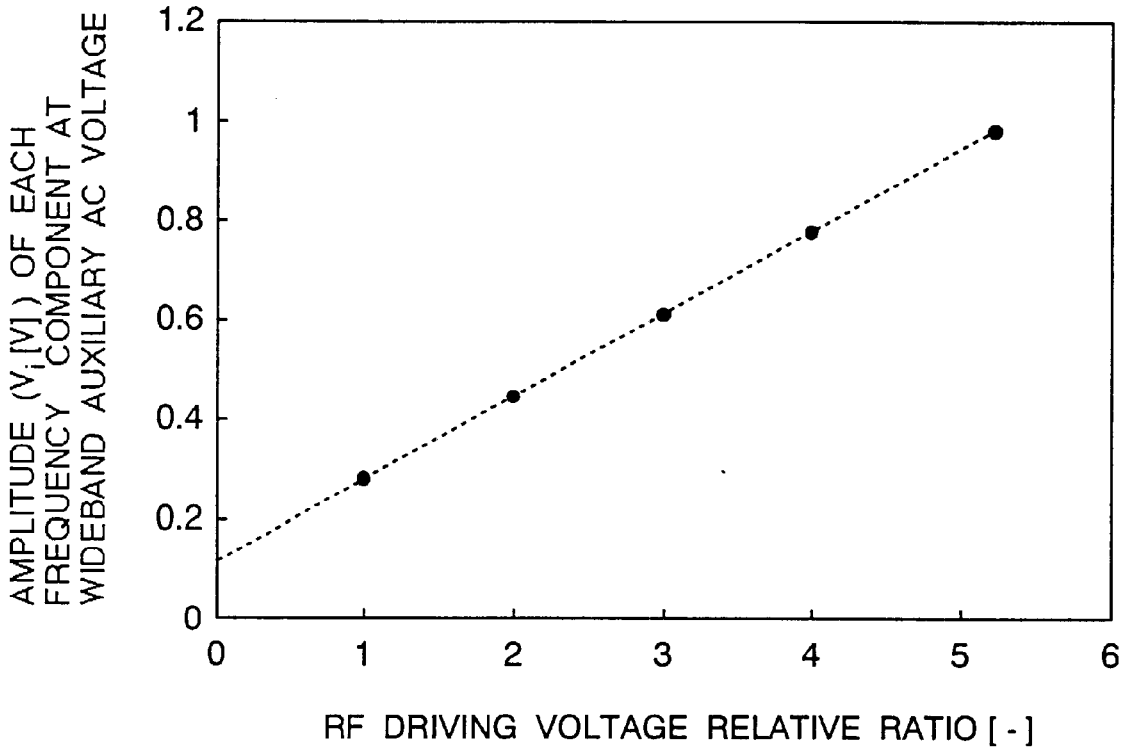
FIG. 10 is a graph showing the relationship between the optimal wideband auxiliary AC voltage value and RF driving voltage value that were obtained from numeric analyses.

FIG. 10 summarizes the above results as the relationship between the RF driving voltage amplitude value, $V_{RF}$, and the optimal voltage amplitude, Vi, of each frequency component at wideband auxiliary AC voltages. It can be seen from FIG. 10 that a proportional relationship exists between the RF driving voltage amplitude value, $V_{RF}$, and the optimal voltage amplitude, Vi, of each frequency component at wideband auxiliary AC voltages.

In other words, the voltage, Vi, of each frequency component at wideband auxiliary AC voltages can be optimized by setting this voltage, $V_i$, so that as shown in FIG. 6*a*, the Vi value increases in proportion to the RF driving voltage amplitude value, $V_{RF}$.

Next, the analytical results in a conventional that the voltage value, Vi, of each frequency component at a wideband auxiliary AC voltage is fixed, not dependent on the RF driving voltage, are shown below. For example, when $V_i$=0.5 V, resolution and exclusion efficiency, compared between those of FIGS. 7*a*, 8*c*, and 9*a*, are as follows: in FIG. 7*a*, although resolution is relatively high, exclusion efficiency is very low; in FIG. 8*c*, although exclusion efficiency is high, resolution is low; and in FIG. 9*a*, although resolution is relatively high, exclusion efficiency is very low.

In other words, the performance obtained changes significantly according to the applied RF driving voltage.

In this embodiment, however, the proportional setting method, in which the voltage, Vi, of each frequency component at wideband auxiliary AC voltages is to be set in proportion to the RF driving voltage amplitude value, $V_{RF}$, enables undesired ions the desired ions to be separated at high resolution, even if the RF driving voltage changes as shown in FIGS. 7*b*, 8*b*, and 9*b*, and undesired ions to be ejected at an efficiency of nearly 100%.

According to this embodiment, therefore, the undesired ions within the specified "m/z" range can be resonantly ejected at high efficiency and the resolution to separate the desired ions from undesired ions according to their masses can be improved. Thus, stable high-performance of mass separation and ejection of ions is ensured. The wideband auxiliary AC voltage setting method in this embodiment also improves ease in the operations of the apparatus since the wideband auxiliary AC voltage can be optimized automatically.

Figure 6B:
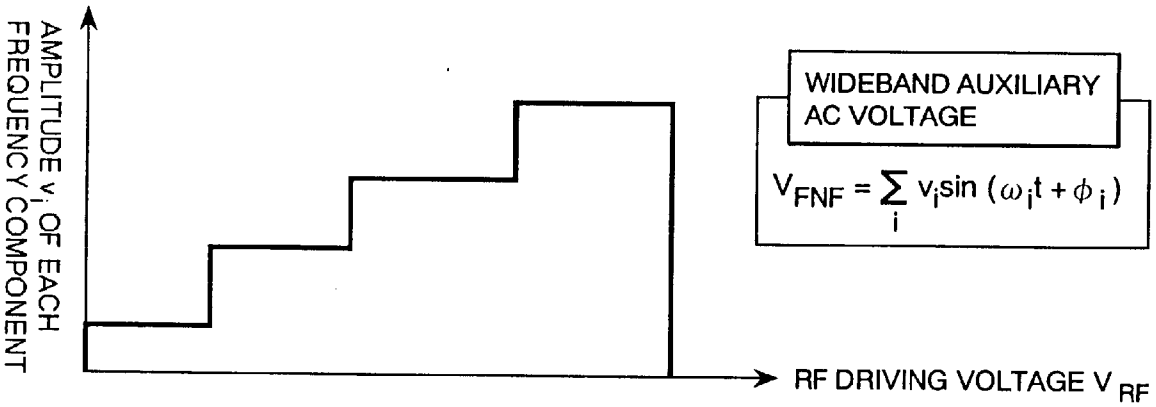

In addition, as shown in FIG. 6*b*, the voltage, Vi, of each frequency component at the wideband auxiliary AC voltage can be increased in steps with respect to the RF driving voltage amplitude value, $V_{RF}$. In this case, it becomes relatively easy to control the voltage, Vi, of each frequency component at the wideband auxiliary AC voltage with respect to the RF driving voltage amplitude value, VRF, and a result, undesired ions can be ejected more efficiently and a high-resolution separation effect between the desired ions and undesired ions can be obtained.

Embodiment 2

Figure 11A:
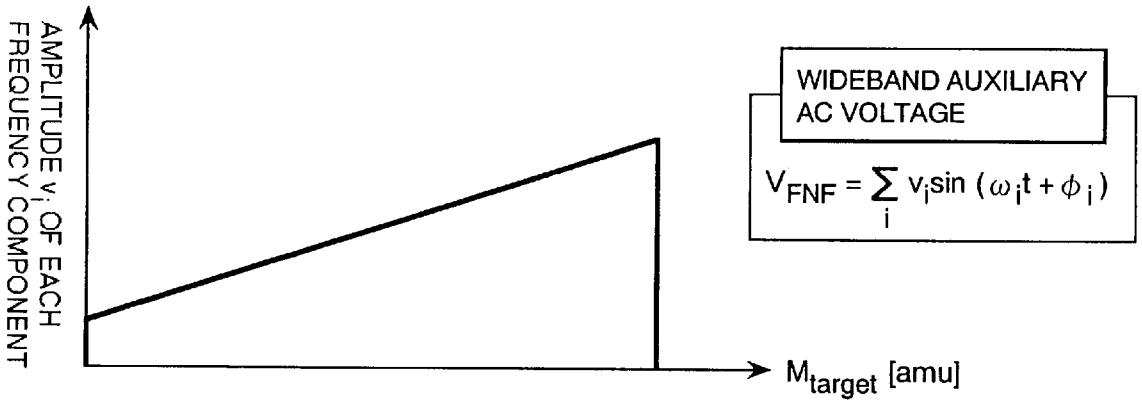
FIG. 11 is a diagram showing the wideband auxiliary AC voltage setting method described in embodiment 2.

Embodiment 2 is described below using FIG. 11. In this embodiment, the voltage amplitude value, Vi, of each frequency component at wideband auxiliary AC voltages is set so that the $V_i$ value is proportional to the mass-to-charge ratio, $M_{target}$, of the ions to be left in the ion trap inter-electrode space.

This method is particularly valid for cases such as MS/MS analysis, in which only specific ion species (parent ions) among all sample ions are to be left and the dissociated ions (daughter ions) that can be obtained by dissociating the parent ions. That is to say, in this embodiment, after the mass-to-charge ratio, $M_{target}$, of the parent ions is inputted to control unit 9, a resonance frequency range equivalent to that of all other ions, namely, undesired ions is desired by control unit 9.

Furthermore, in control unit 9, the voltage, $V_i$, of each frequency component at wideband auxiliary AC voltages is to be set so that Vi is proportional to the mass-to-charge ratio, $M_{target}$. When the "q" value (see expression (1)) of the parent ions is usually set to almost the same "q" value within a stability region in any case, it can be seen from expression (1) that the ion mass number is almost proportional to the RF driving voltage, $V_{RF}$. In other words, the fact that the voltage, Vi, of each frequency component at wideband auxiliary AC voltages is proportionated to the mass-to-charge ratio, $M_{target}$, is almost synonymous with the fact that Vi is proportionated to the RF driving voltage amplitude, $V_{RF}$.

Figure 11B:
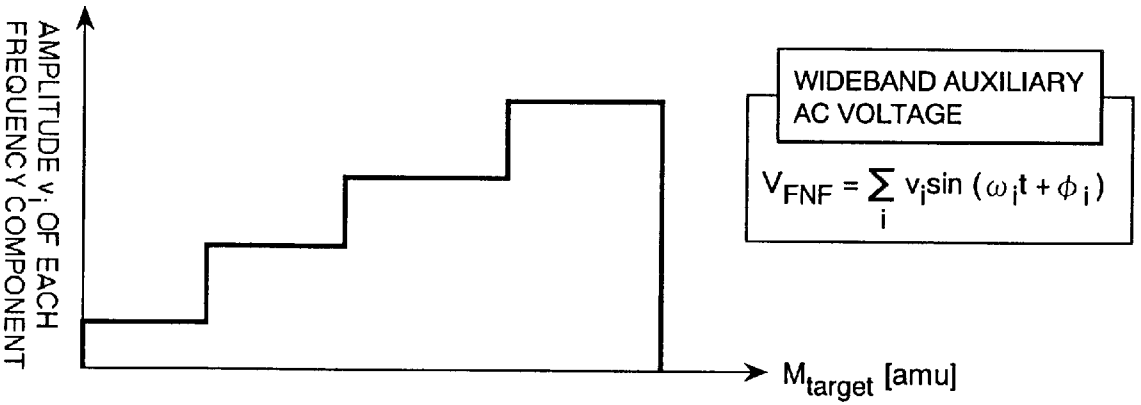

As in embodiment 1, therefore, in embodiment 2 as well, the undesired ions within the specified "m/z" range are resonantly ejected with high efficiency and the resolution to separate the desired ions from undesired ions according to their masses is improved. At this time, as shown in FIG. 11*b*, the voltage, $V_i$, of each frequency component at wideband auxiliary AC voltages can be increased in steps with respect to the mass-to-charge ratio, $M_{target}$, of the parent ions.

Also, a specific frequency within the frequency range of the wideband auxiliary AC voltages can be proportionated to the "m/z" value of the ion oscillating with a frequency that is, equal to the resonant frequency, not to the mass-to-charge ratio, $M_{target}$, of the ions to be left in the ion trap inter-electrode space, and the voltage amplitude $V_i$ of each frequency component of the wideband auxiliary AC voltages can be set.

Embodiment 3

Embodiment 3 is described below using FIG. 12. This embodiment is characterized in that after the resonance frequency ranges of both the ions to be analyzed (the desired ions) and undesired ions have been calculated from the specified "m/z" ranges of the desired ions and undesired ones by control unit 9, the voltage amplitude ($V_i$) of each frequency component at a wideband auxiliary AC voltage that has a frequency of "$f_i$" ($=\omega i/2\pi$) close to the resonance frequency range of the desired ions, within the resonance frequency range of the undesired ions, is set so as to be smaller than that the frequency component's voltage amplitude ($V_i$) whose frequency ($f_i=\omega i/2\pi$) is distanced from the resonance frequency range of the desired ions at all times.

Figure 12A:
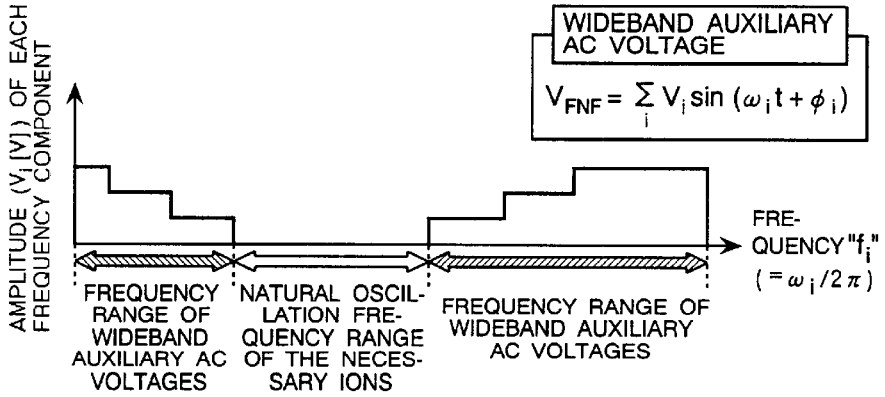
FIG. 12 is a diagram showing the wideband auxiliary AC voltage setting method described in embodiment 3.

In FIG. 12*a*, within the resonance frequency range of the undesired ions (namely, the frequency range of wideband auxiliary AC voltages), as the frequency region corresponding to the voltage amplitude, $V_i$, of each frequency component at the wideband auxiliary AC voltage gradually is distanced from a frequency region close to the resonance frequency range of the desired ions, the voltage amplitude Vi of each frequency components is increased in steps.

The effectiveness of actual numeric analysis using this step-by-step incremental method relating to the voltage amplitude, $V_i$, of each frequency component is described below.

In this embodiment, ions from 600 to 649 amu in mass number are taken as the desired ions, and ions from 650 to 1,012 amu in mass number are taken as undesired ions. The maximum oscillation amplitude value, $A_{max}$, in the ion trap inter-electrode space of 600–1100 amu ions, obtained by the application of wideband auxiliary AC voltages with a frequency division width of 1 kHz between the adjoining frequency components within the 150–270 kHz resonance frequency range of the undesired ions, has been calculated.

Figure 13A:
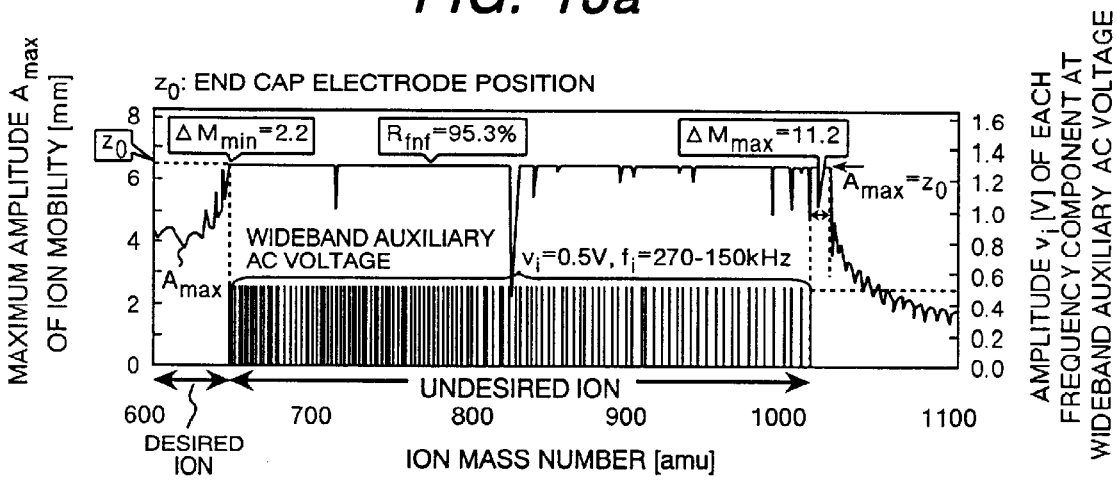
FIG. 13 shows the results of numeric analyses on the maximum oscillation amplitude value, $A_{max}$, of 600–1100 amu ions that was obtained in embodiment 3 when wideband auxiliary AC voltages were applied.
Figure 13B:
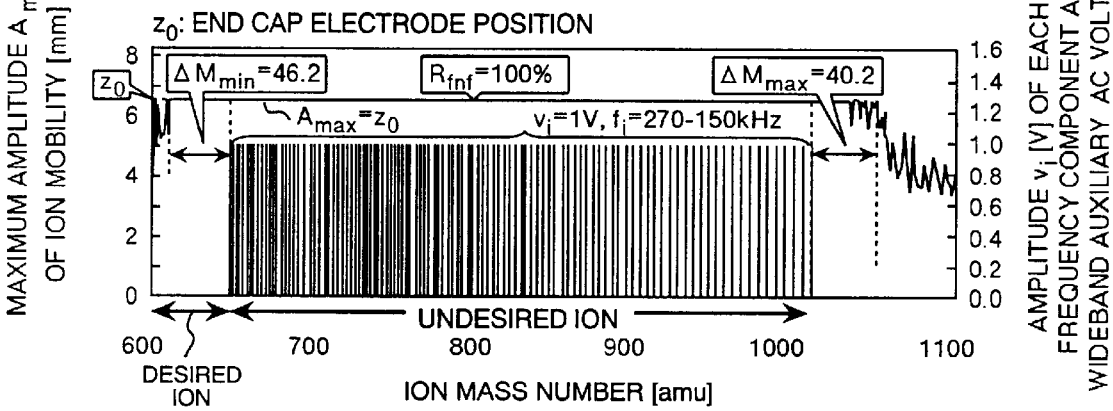

FIGS. 13*a* and 13*b* show the results of setting constant $V_i$ values of 0.5 V and 1.0 V for the voltage amplitude, $V_i$, of each frequency component at a wideband auxiliary AC voltage.

In FIG. 13*a*, many of the ions at the lower-mass-number side within the mass range of the undesired ions have their maximum amplitude, $A_{max}$, reached at the end cap electrode position, $z_0$, and the undesired ions and the desired ions are separated at high resolution ($\Delta M_{min}=-2.2$ amu).

At the same time, it can be seen that the ions at the higher-mass-number side within the mass range of the undesired ions decrease in release efficiency (4.7% of the ions is not ejected) since they are left in the ion trap inter-electrode space without their maximum amplitude, Amax, being reached at the end cap electrode position, $z_0$.

In FIG. 13*b*, although many of the ions at the higher-mass-number side within the mass range of the undesired ions have their maximum amplitude, Amax, reached at the end cap electrode position, $z_0$, and their resonant exclusion efficiency is very high (100%), since some of the desired ions overstep the range of the undesired ions and these ions are also resonantly ejected, the resolution to separate the desired ions from the undesired ions decreases significantly ($\Delta M_{min}=46.2$ amu).

For this reason, within the resonance frequency range of the undesired ions (namely, the frequency range of wideband auxiliary AC voltages), as the frequency of each frequency component at the wideband auxiliary AC voltage gradually is distanced from a frequency region close to the resonance frequency range of the desired ions, the Vi value of each frequency component is increased in steps. The results are shown in FIG. 13*c*.

Figure 13C:
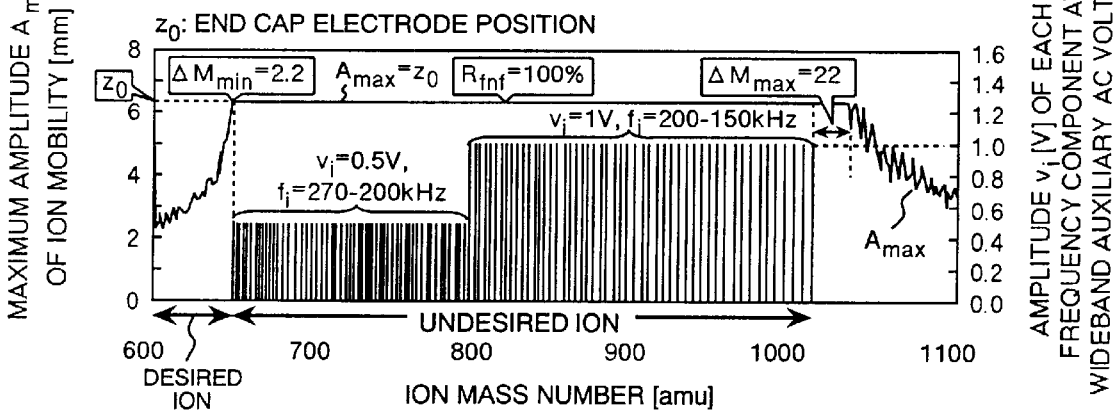

In FIG. 13*c*, after resonance frequencies from 150 to 270 kHz have been divided into a region from 150 to 200 kHz and a region from 200 to 270 kHz, the Vi value is set to 0.5 V in the 200–270 kHz region, which is closer to the resonance frequencies of the desired ions, and $V_i$ is set to 1.0 V in the 150–200 kHz region, which is more distanced from the resonance frequencies of the desired ions.

This indicates that the maximum amplitude, $A_{max}$, of the higher-mass-number ions is reached at the end cap electrode position, $z_0$, and thus that these ions are resonantly ejected at a high efficiency of 100%. Also, the border of the resonance frequency ranges of the desired ions and undesired ions almost agrees with the border of the ions that have reached the end cap electrode position, $z_0$, and the ions that have not reached this position. That is to say, $\Delta M_{min}=-2.2$ amu, and this means that the desired ions and the undesired ions are separated at very high resolution.

This embodiment, therefore, brings about the effects that, regardless of their mass number, undesired ions are ejected with high efficiency and that the desired ions and the undesired ions are separated at very high resolution.

Figure 12B:
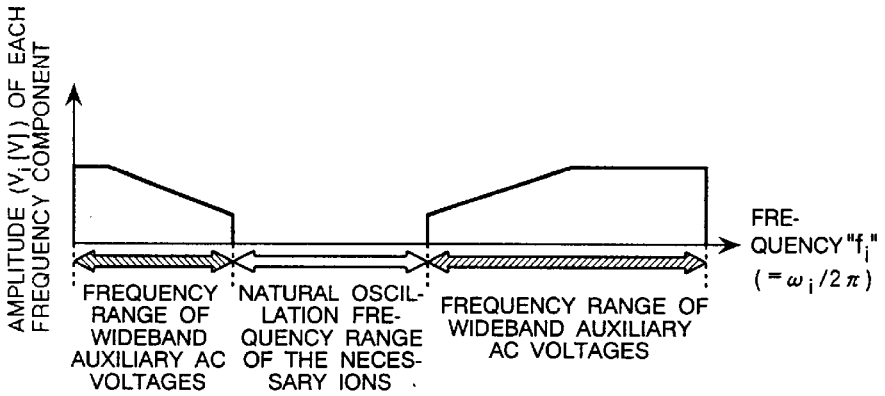
Figure 12C:
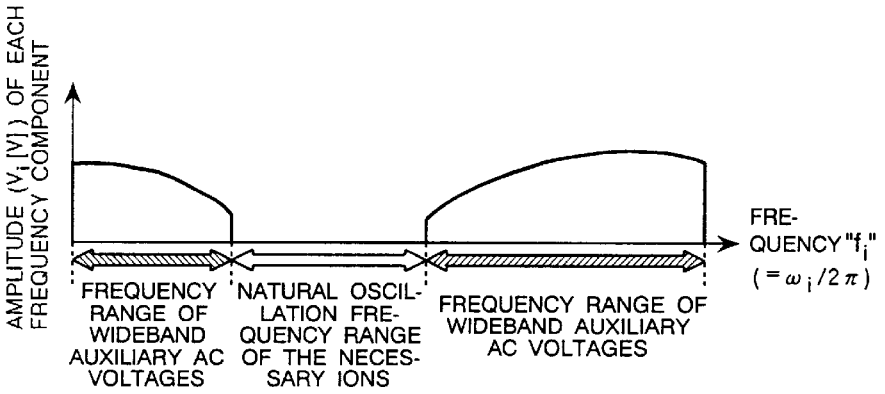
Figure 12D:
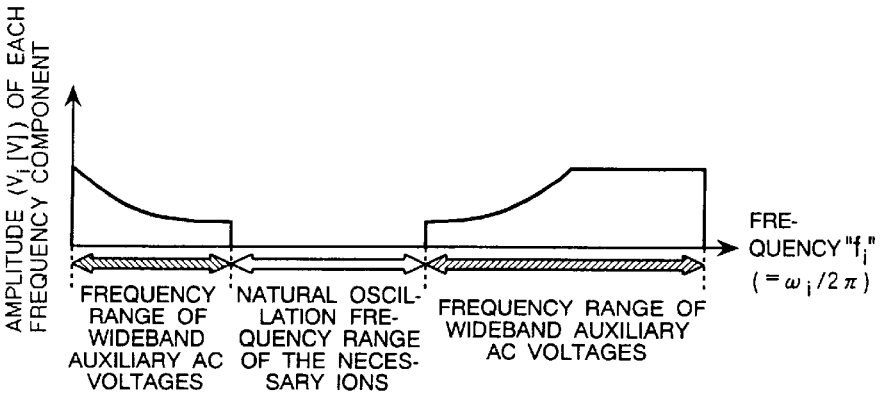

In this case, in the method of increasing the amplitude value, Vi, of each frequency component as the frequency, "fi" (=ωi/2π), of each frequency component at wideband auxiliary AC voltages deviates from the resonance frequency range of the desired ions, similar effects can also be anticipated by increasing Vi either linearly as shown in FIG. 12*b*, or curvilinearly as shown in FIGS. 12*c* and 12*d*.

Embodiment 4

Embodiment 4 is described below using FIG. 14. This embodiment is characterized in that at a wideband auxiliary AC voltage within the resonance frequency range of undesired ions that has been calculated from the specified "m/z" range of the undesired ions by control unit 9, the voltage amplitude (Vi) of each frequency component that has a frequency of "$f_i$" (=ωi/2π) close to either end of the corresponding frequency range is set so as to be smaller than that the frequency component's voltage amplitude ($V_i$) whose frequency ($f_i$=ωi/2π) is equivalent to the median region of the resonance frequency range at all times.

Figure 14A:
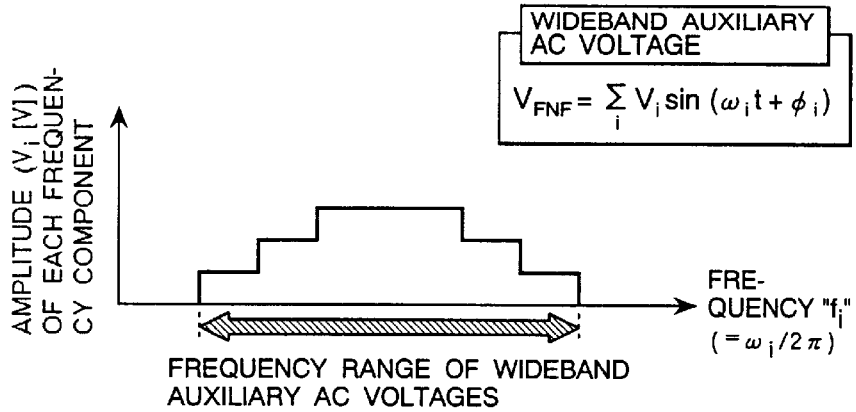
FIG. 14 is a diagram showing the wideband auxiliary AC voltage setting method described in embodiment 4.

In FIG. 14*a*, a value is set so that as the frequency of "f" (=ωi/2π), of each frequency component at a wideband auxiliary AC voltage is far from either end of the resonance frequency range and becomes close to the median region of this frequency range, "$f_i$" will be increased in steps with respect to the amplitude value, $V_i$, of each frequency component.

The results of the numeric analyses are shown in FIG. 13*c* that although the resolution at the lower-mass-number side within the mass number range of undesired ions is very high ($\Delta M_{min}=-2.2$ amu), the resolution near the end of the higher-mass-number side remains low ($\Delta M_{min}=22$ amu) since non-specified ions are also ejected.

If the region at the higher-mass-number side within the mass number range of undesired ions is also taken as falling in the mass number range of the desired ions, the resolution to separate the desired ions from the undesired ions decreases in that region.

Therefore, if the mass number region of undesired ions is wedged between the two regions of the desired ions, the application of this embodiment enables ions in both the desired and undesired regions to be separated with high resolution at both ends of the "m/z" range of the desired ions by setting the voltage amplitude values of each frequency component at wideband auxiliary AC voltages as shown in FIG. 14*a*.

Figure 14B:
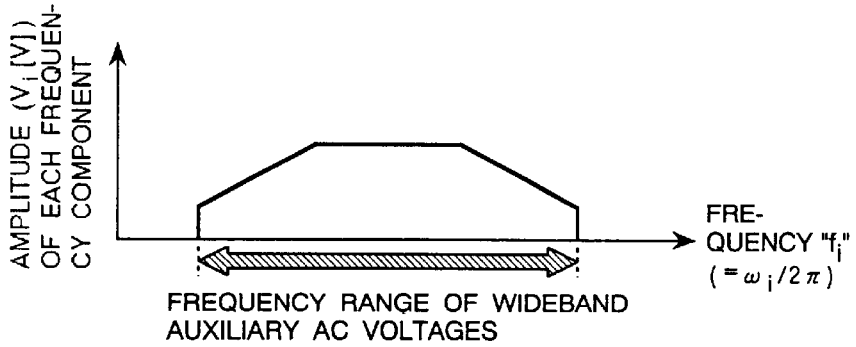
Figure 14C:
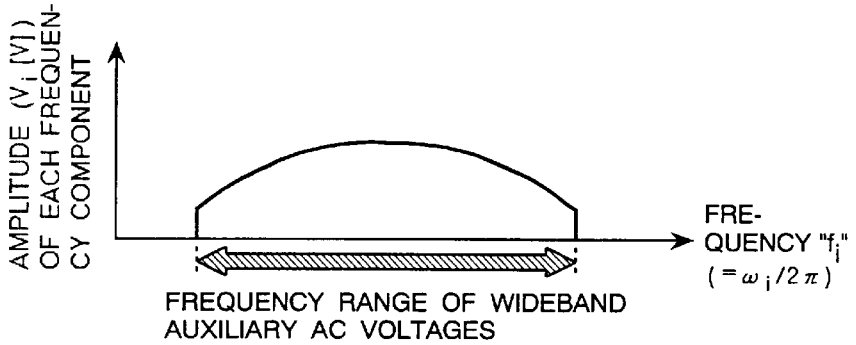
Figure 14D:
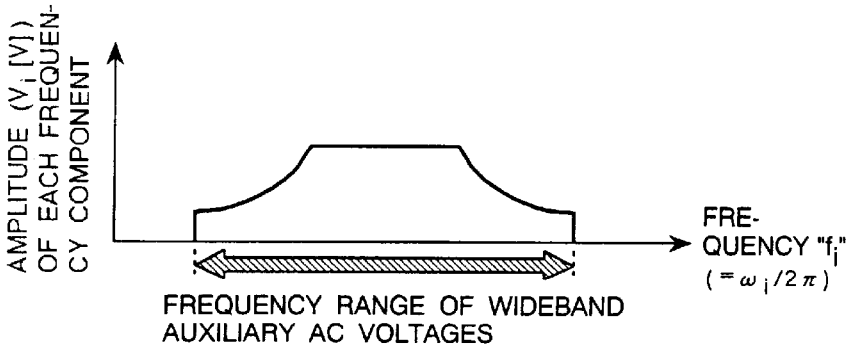

In this case, in the method of increasing the amplitude values, Vi, of individual component wideband auxiliary AC voltages as the frequency, "$f_i$" (=ωi/2π), of each frequency component at the wideband auxiliary AC voltages deviates from either end of the resonance frequency range of undesired ions, similar effects can also be anticipated by increasing "$f_i$" either linearly as shown in FIG. 14*b*, or curvilinearly as shown in FIGS. 14*c* and 14*d*.

Embodiment 5

Embodiment 5 is described below using FIGS. 15 to 18. This embodiment is characterized in that in terms of "$f_{i+1}-f_i=\Delta f_i$" (the frequency difference between the adjacent frequency components of wideband auxiliary AC voltages), the frequency division width, "$\Delta f_i$", in the higher frequency region of the resonance frequency range of undesired ions (namely, the frequency range of the wideband auxiliary AC voltages) is so set as to increase above the frequency division width, "$\Delta f_i$", that corresponds for the lower frequency region.

Figure 15A:
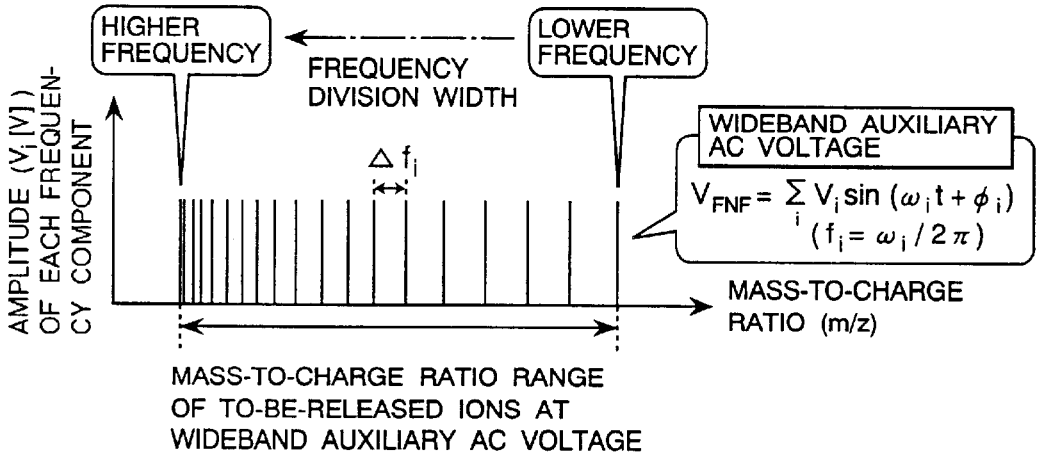
FIG. 15 is an epitomized diagram representing the relationship between the frequency components of wideband auxiliary AC voltages at a fixed frequency division width, and the mass-to-charge ratio of the ions to be resonated.
Figure 15B:
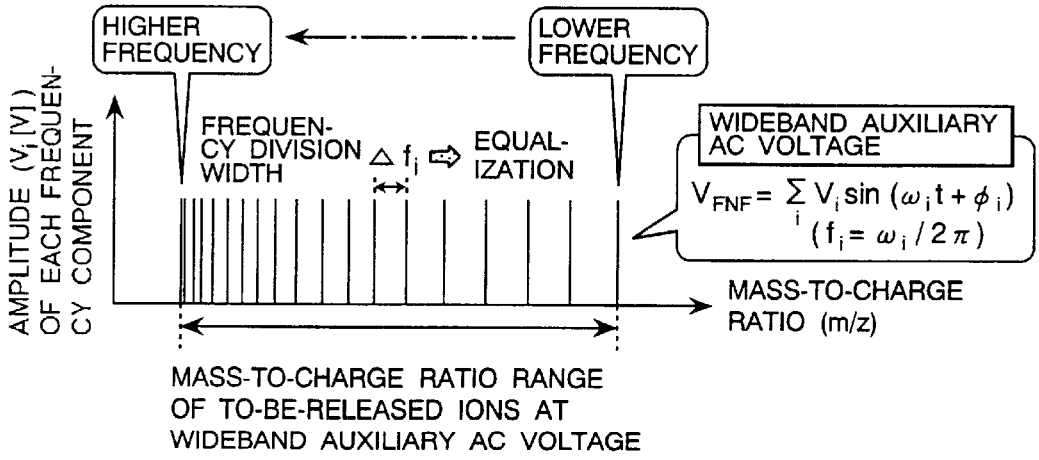

When the frequency division width, "$\Delta f_i$", between the adjacent frequency components of the wideband auxiliary AC voltages is constant, as shown in FIG. 15*a*, the frequency components of these auxiliary AC voltages concentrate as the resonance frequency becomes close to the lower-mass-number ion area in which $\Delta f_i$ increases. This state can be represented as the expression (3) obtained in approximated form by modifying expression (1).

$$\Delta M=CM^2\Delta f \tag{3}$$

where M, C, and ΔM denote an ion mass number, a constant, and a wideband auxiliary AC voltage, respectively, and the mass number interval, ΔM, of the ions resonated by each frequency component at fixed intervals of the frequency division width, "Δf". It can therefore be seen that when the frequency division width, "Δf", is constant, the difference (ΔM) in mass number between the ions resonated decreases with an increasing number of lower-mass-number ions. In other words, the allocation of resonance voltages concentrates on ions lower in mass number.

Figure 16A:
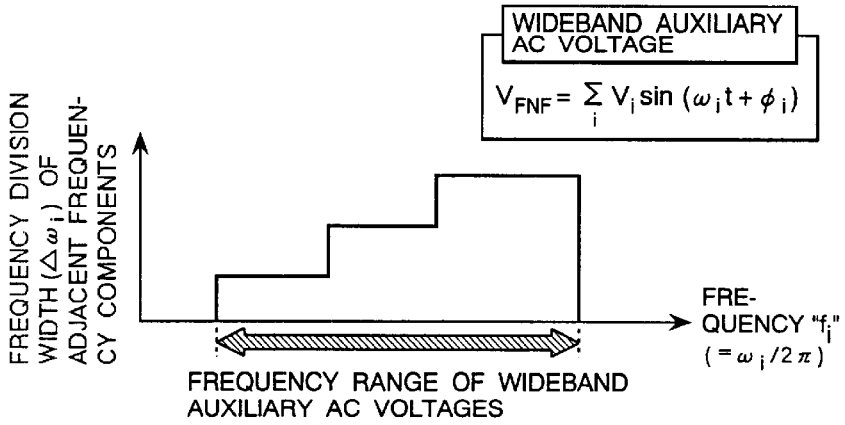
FIG. 16 is a diagram showing the method of setting the frequency division width of a wideband auxiliary AC voltage according to the frequency in embodiment 5.

In this embodiment, therefore, as shown in FIG. 16*a*, the frequency division width "Δfi" is increased in steps as the frequency, "$f_i$" (=ωi/2π), of each frequency component at a wideband auxiliary AC voltage increases in the resonance frequency range (the frequency range of wideband auxiliary AC voltages). That is to say, as shown in 15*b*, since the frequency division width of each frequency component at the wideband auxiliary AC voltage is increased with respect to lower-mass-number ions in higher resonance frequency, the inequality of resonance voltage allocation is reduced, regardless of the ion mass number.

Figure 17A:
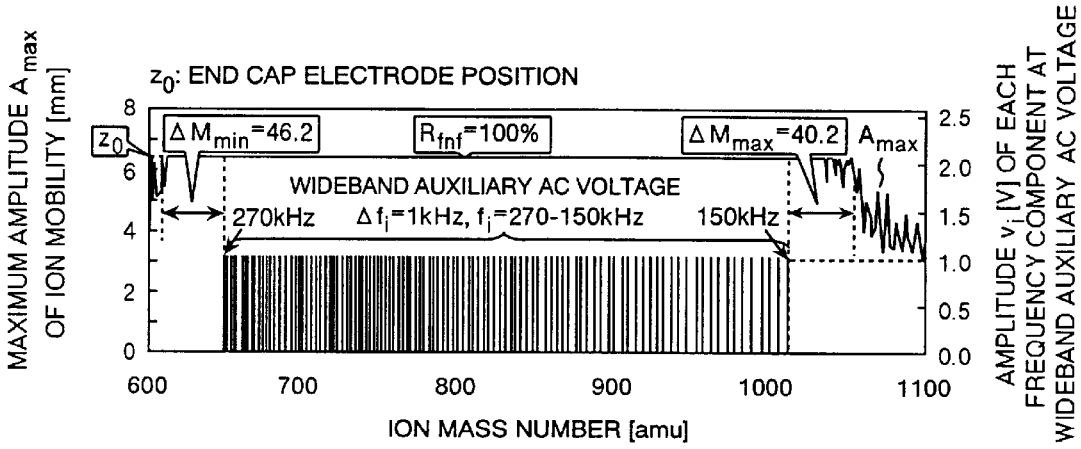
FIG. 17 shows the results of numeric analyses on the maximum oscillation amplitude value, $A_{max}$, of 600–1100 amu ions that was obtained in embodiment 5 when wideband auxiliary AC voltages were applied.

Actual numeric analyses on the effectiveness of this embodiment are shown in FIG. 17. FIG. 17*a* shows the result of the numeric analyses on the maximum oscillation amplitude, $A_{max}$, of 600–1100 amu ions, obtained by the application of wideband auxiliary AC voltages with a fixed frequency division width of 1 kHz, within the 150–270 kHz resonance frequency range of the undesired ions as with the prior art.

At this time, the mass number range of undesired ions is from 649 to 1012 amu. According to this, since not only the undesired ions within the specified species range but also the desired ions are resonantly ejected, separation resolution between the desired ions and undesired ions is very low ($\Delta M_{min}=46.2$ amu, $\Delta M_{max}=40.2$ amu).

Figure 17B:
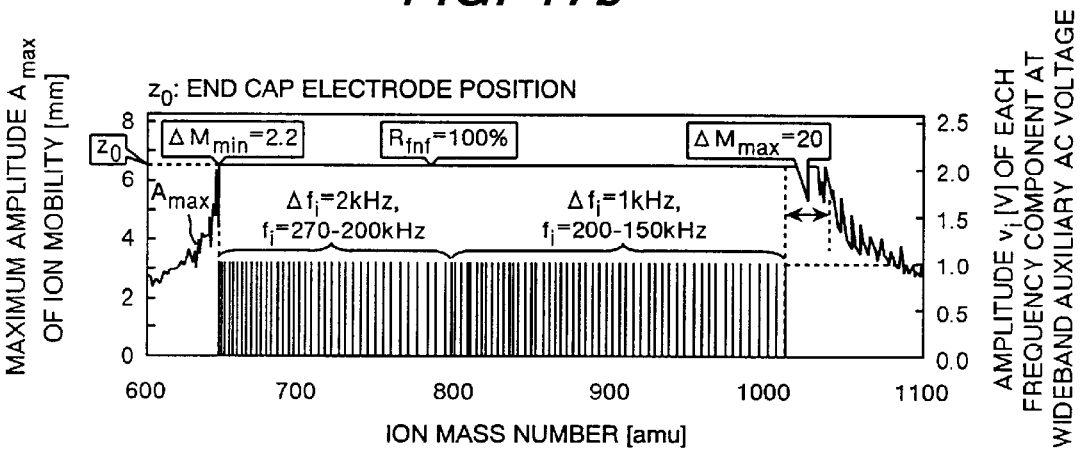
Figure 17C:
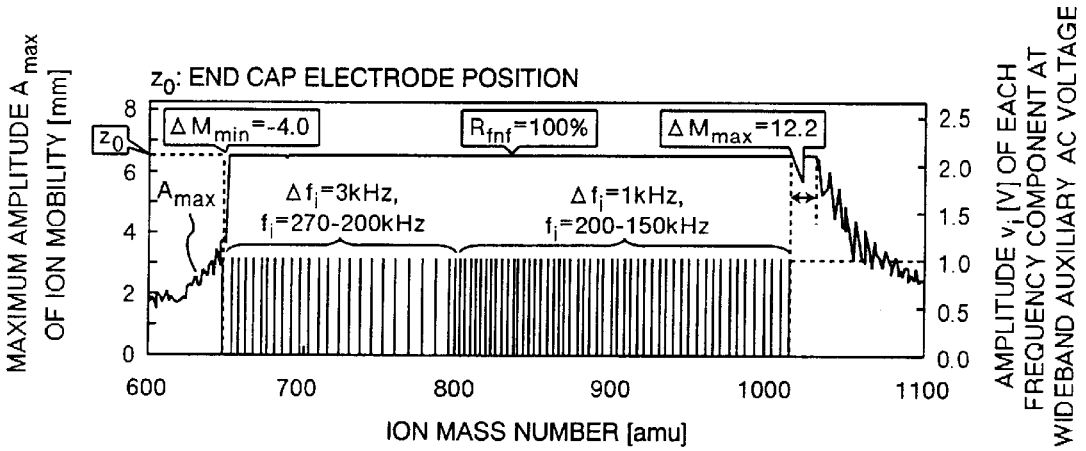
Figure 18A:
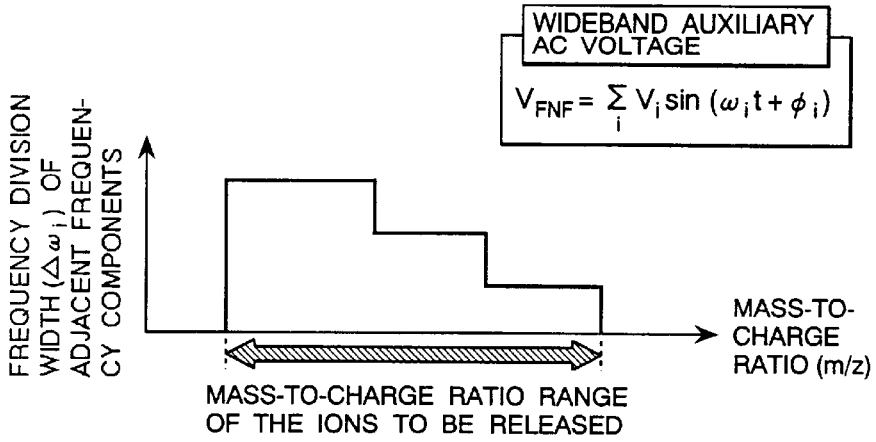
FIG. 18 is a diagram showing the method of setting the frequency division width of a wideband auxiliary AC voltage according to the mass-to-charge ratio of the to-be-ejected ions in embodiment 5.
Figure 18B:
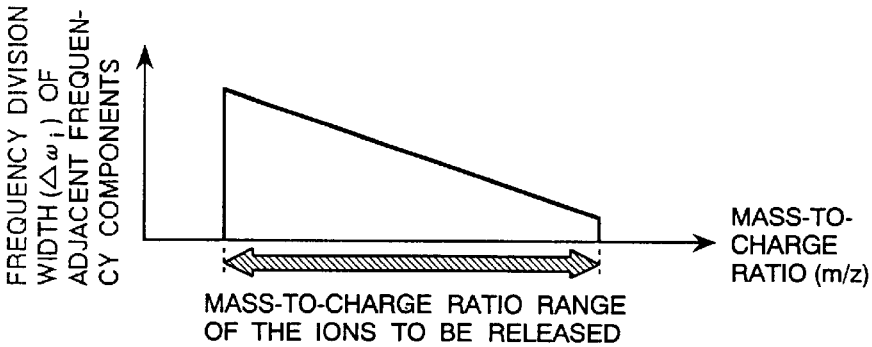
Figure 18C:
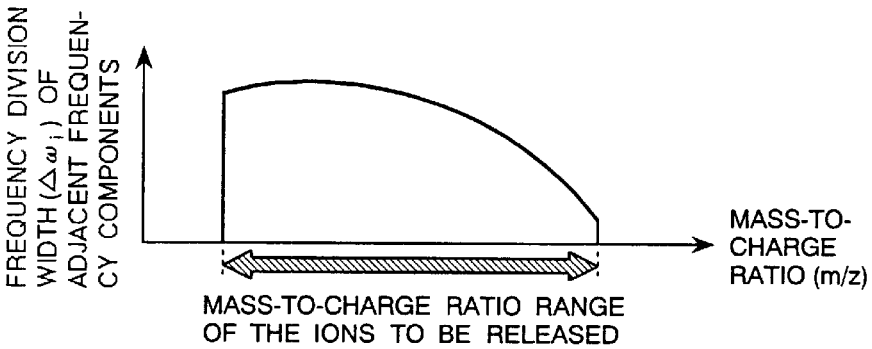
Figure 18D:
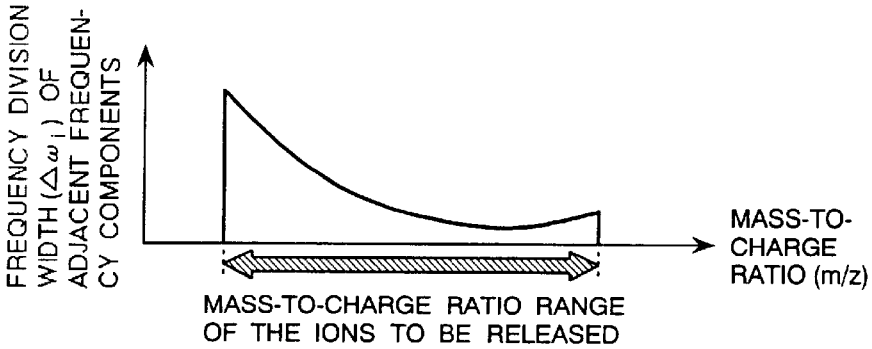

For this reason, resonance frequencies from 150 to 270 kHz were divided into a region from 150 to 200 kHz and a region from 200 to 270 kHz and the frequency division width, "$\Delta f_i$" is set to 2 kHz in the higher frequency range from 200 to 270 kHz while $\Delta f_i$ is set 1 kHz for the lower frequency range from 150–200 kHZ. The results are shown in FIG. 17*b*. FIG. 17*c* shows the numerical analysis results in the case that Δfi is set to 3 kHz and 1 kHz for the range of 200–270 kHz and 150 kHz–200 kHz, respectively.

In both cases, compared with the case of FIG. 17*a*, separation resolution between the desired ions and undesired ions improves to $\Delta M_{min}$=2.2 amu (FIG. 17*b*) and $\Delta M_{min}$=−4.0 amu (FIG. 17*c*) at the lower-mass-number side, and $\Delta M_{max}$=20 amu (FIG. 17*b*) and $\Delta M_{max}$=12.2 amu (FIG. 17*c*) at the higher-mass-number side. Resolution improves significantly at the lower-mass-number side, in particular.

Accordingly, since, irrespective of the ion mass number, resonance voltage allocations are equalized, the nonuniformity of resolution and other performances due to changes in ion mass number can be avoided.

Figure 16B:
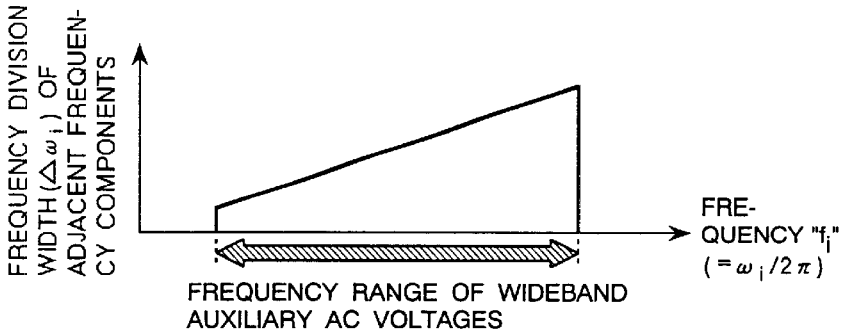
Figure 16C:
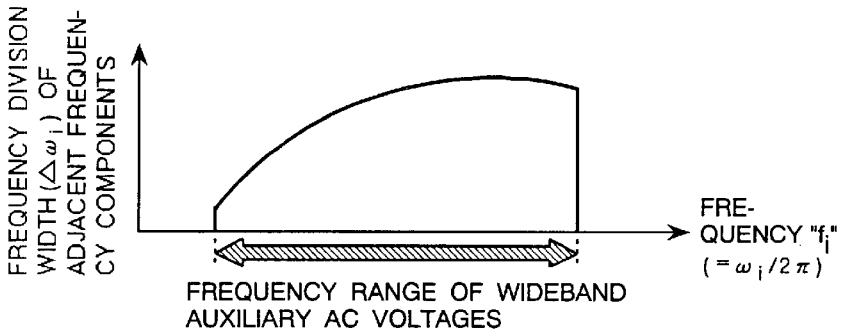
Figure 16D:
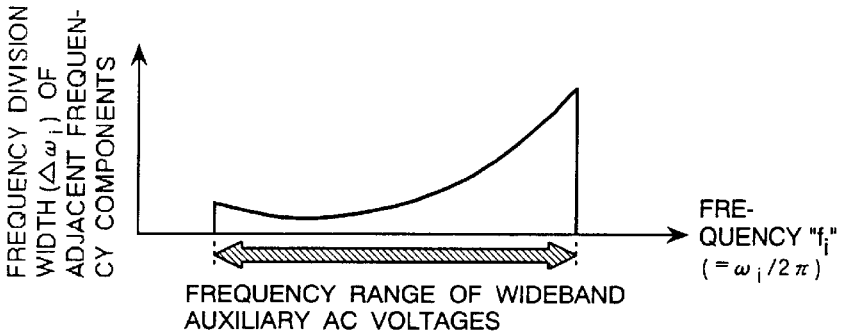

In this case, in the method of determining the appropriate frequency division width, "$\Delta f_i$", according to the frequency, "$f_i$" (=ωi/2π), of the frequency components at the wideband auxiliary AC voltage, similar effects can also be anticipated by increasing "$\Delta f_i$", as shown in FIG. 16*b*, 16*c*, and 16*d*, either linearly (FIG. 16*b*) or curvilinearly (FIGS. 16*c* and 16*d*), as the frequency within the resonance frequency range of undesired ions.

Also, as shown in FIGS. 18*a* to 18*d*, the frequency division width, "$\Delta f_i$", can be set so that in accordance with expression (3) shown earlier in this document, "$\Delta f_i$" will be reduced as the number of undesired ions at the higher-mass-number side increases. Similar effects can also be anticipated by increasing the frequency division width, "$\Delta f_i$", in steps (FIG. 18*a*), either linearly (FIG. 18*b*) or curvilinearly (FIGS. 18*c* and 18*d*), as the number of undesired ions at the higher-mass-number side increases.

Embodiment 6

Embodiment 6 is described below using FIGS. 19 to 20. In this embodiment, as shown in FIG. 19, the setting of the amplitude value $V_i$ of each frequency component at wideband auxiliary AC voltages is changed between the case that the frequency range of the wideband auxiliary AC voltages and the resonance frequency range of undesired ions almost agree, and the case that the frequency range of the wideband auxiliary AC voltages becomes narrower than the resonance frequency range of the undesired ions.

Figure 19A:
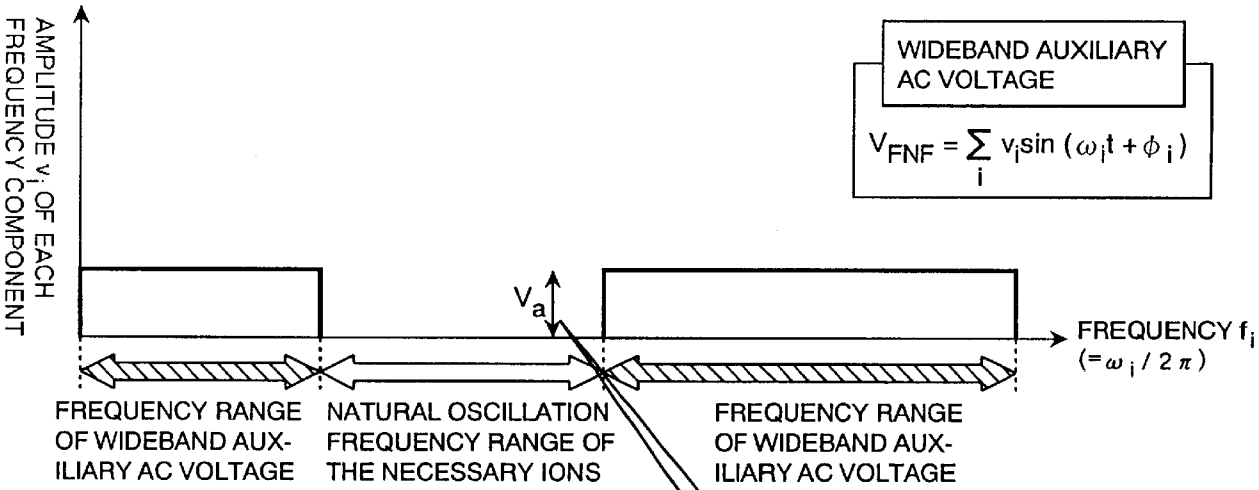
FIG. 19 is a diagram showing the wideband auxiliary AC voltage setting method described in embodiment 6.
Figure 19B:
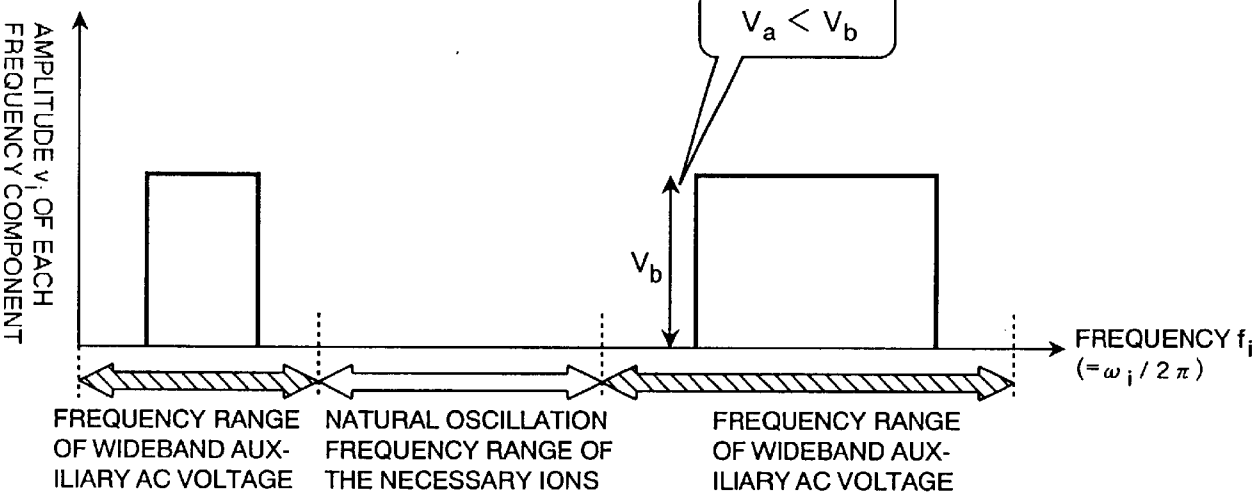
Figure 20A:
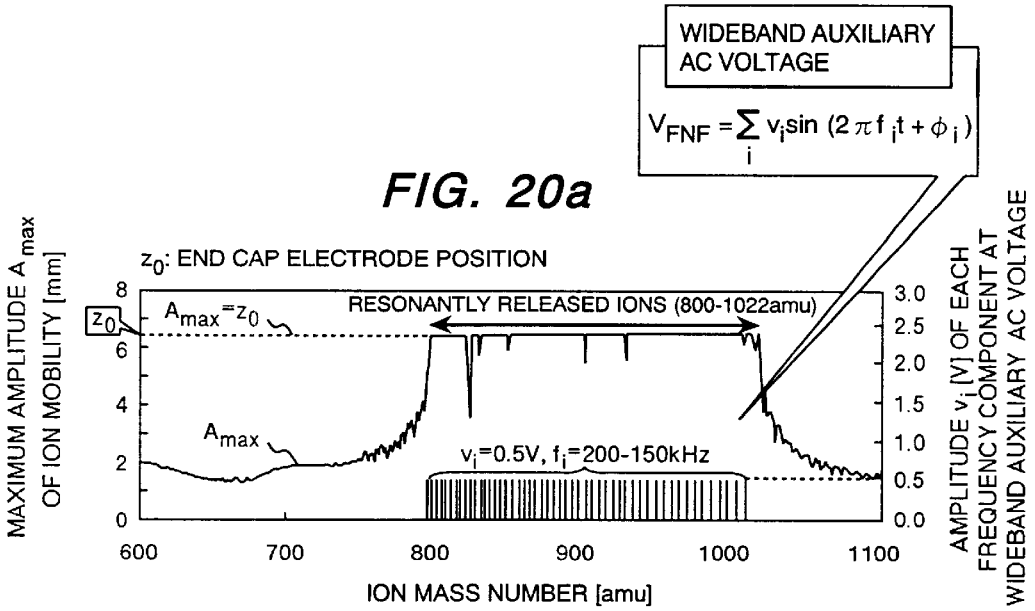
FIG. 20 shows numeric analyses on the maximum oscillation amplitude value, $A_{max}$, of 600–1100 amu ions that was obtained in embodiment 6 when wideband auxiliary AC voltages were applied.
Figure 20B:
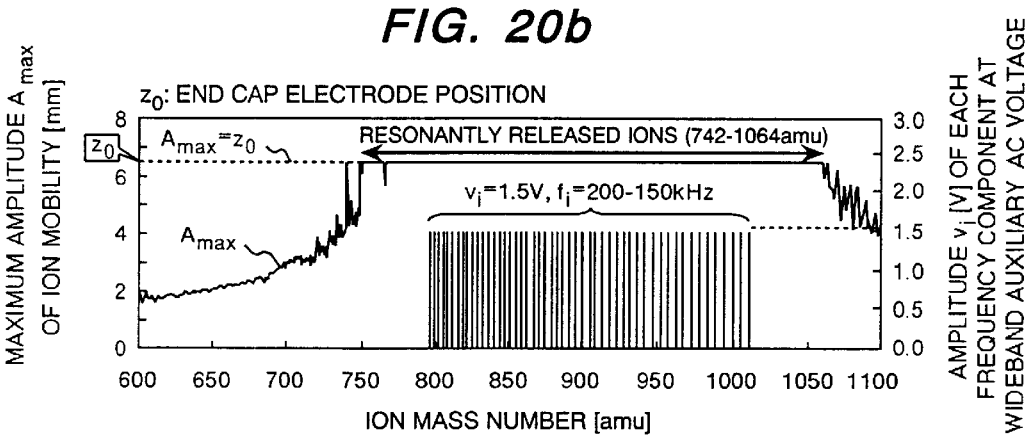
Figure 20C:
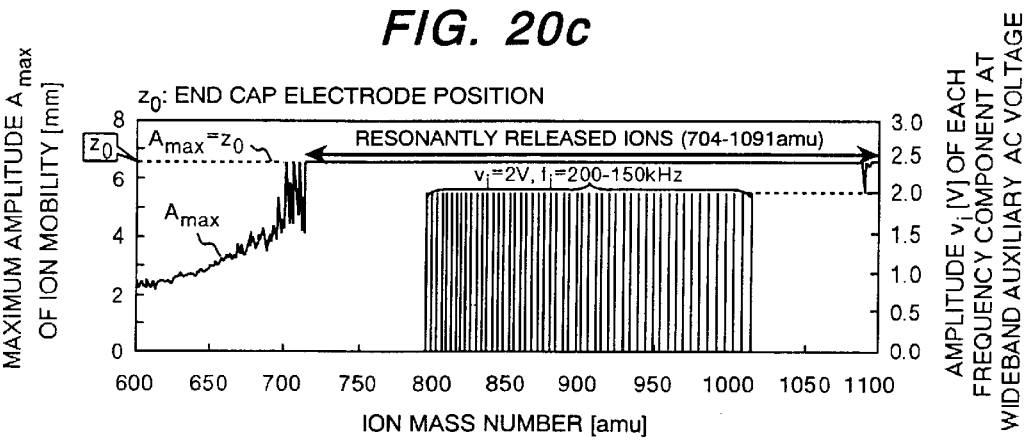

When the amplitude value, $V_i$, in the case that the frequency range of the wideband auxiliary AC voltages and the resonance frequency range of undesired ions almost agree is taken as "$V_a$" and the amplitude value, $V_i$, in the case that the frequency range of the wideband auxiliary AC voltages becomes narrower than the resonance frequency range of the undesired ions is taken as "$V_b$", these two values are set so that as shown in FIG. 19, they will be maintained in a relationship of "$V_a<V_b$".

Next, the results of actual verification of the effectiveness of this embodiment by numeric analysis are shown. FIG. 20 shows the results of the numeric analyses on the maximum oscillation amplitude, $A_{max}$, of the 600–1100 amu ions existing when the amplitude, "$V_i$", of each frequency component was changed to 0.5, 1.5 and 2.0 V, at a wideband auxiliary AC voltage within a relatively narrow frequency range of 150–200 kHz for a frequency division width (Δf) of 1 kHz.

The mass number range corresponding to the frequency range of this wideband auxiliary AC voltage is from 649 to 1012 amu.

As the amplitude value, $V_i$, of each frequency component increases, the mass number range of the actual ions that are resonantly ejected, increases to 742–1064 amu at a "$V_i$" value of 1.5 V and to 704–1091 amu at a "$V_i$" value of 2.0 V.

Therefore, the resonance frequency range of the ions to be resonantly ejected can be extended by increasing the amplitude value, $V_i$, of each frequency component as the frequency range of the wideband auxiliary AC voltages becomes narrower than the resonance frequency range of the ions to be resonantly ejected. That is to say, in this embodiment, low-resolution ion separation at both ends of the mass number range of undesired ions is utilized. According to this embodiment, ions overstepping the specified mass number range of undesired ions can also be resonantly ejected, even if the frequency range of the wideband auxiliary AC voltages is limited.

Embodiment 7

Figure 21:
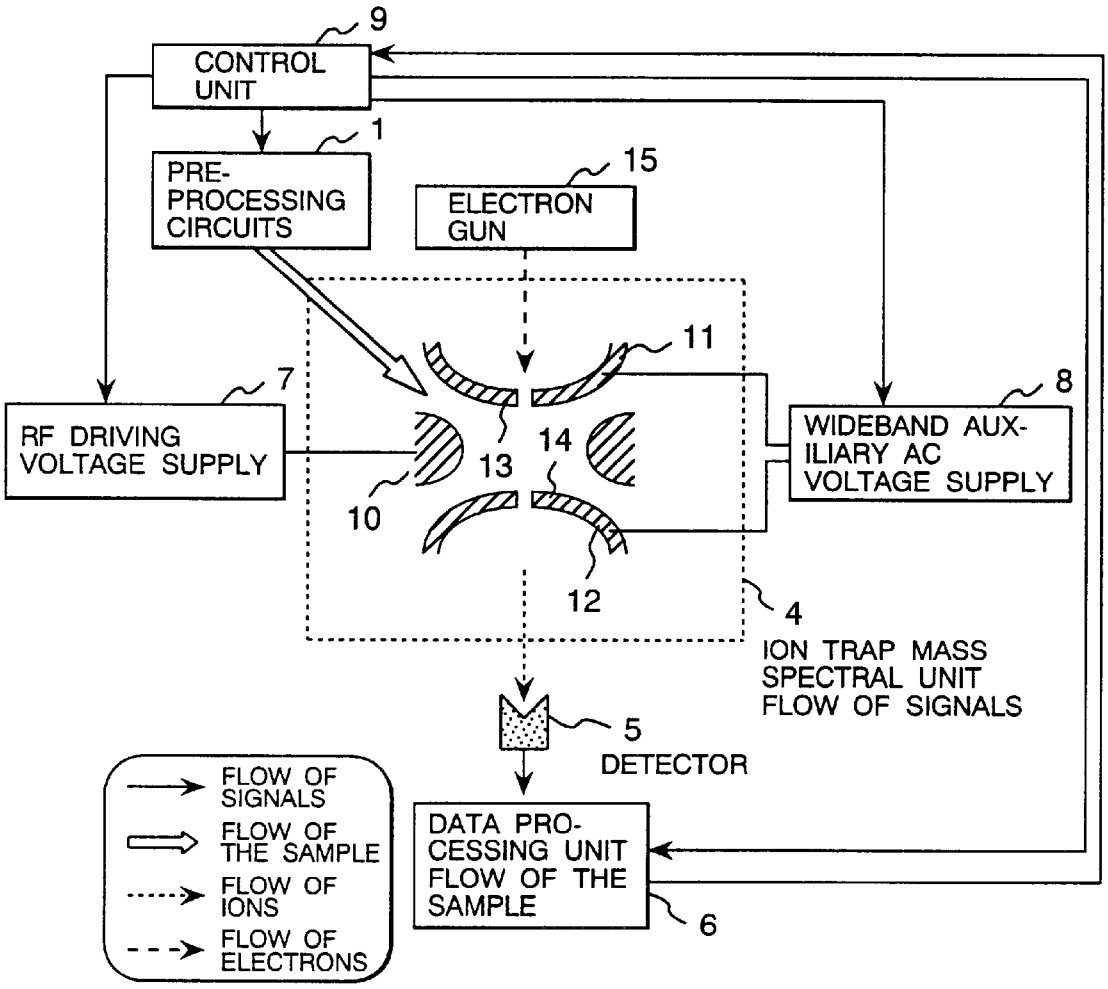
FIG. 21 is a total schematic diagram of the ion trap mass spectrometer described in embodiment 7.

Embodiment 7 is described below using FIGS. 21 and 4*b*. In this embodiment, as shown in FIG. 21, the specimen to be analyzed is ionized in the ion trap inter-electrode space between the ring electrode 10 and two end cap electrodes 11 and 12 located inside ion trap mass spectral unit 4. More specifically, after the specimen whose ingredient had been separated through pre-processing unit 1 has been introduced into the ion trap inter-electrode space, this specimen is ionized therein by being collided with the electrons that have been injected from electron gun 15 through injection port 13.

Figure 4B:
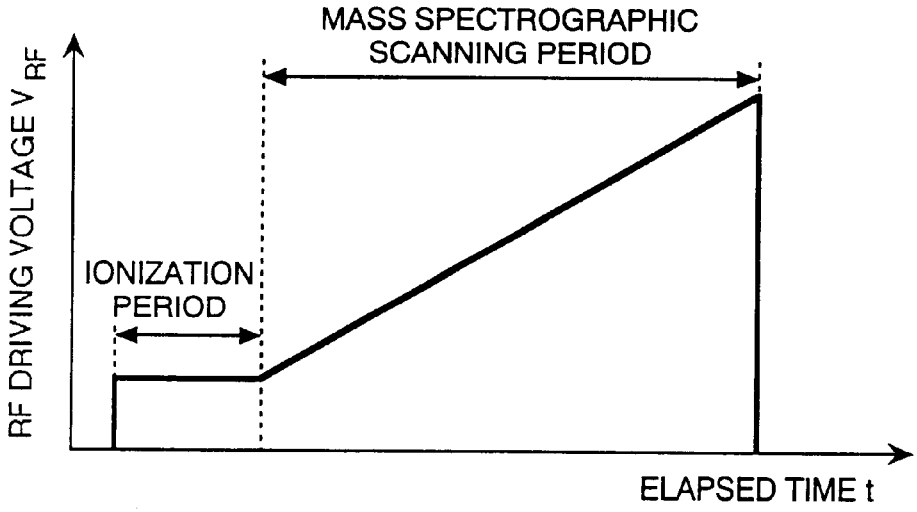

At this time, wideband auxiliary AC voltages are applied during the ionization period, as shown in FIG. 4*b*. Even when ionization occurs inside ion trap mass spectral unit 4 as shown in this embodiment, the methods of applying wideband auxiliary AC voltages, described in each embodiment up to now, can be used.

Embodiment 8

Figure 22:
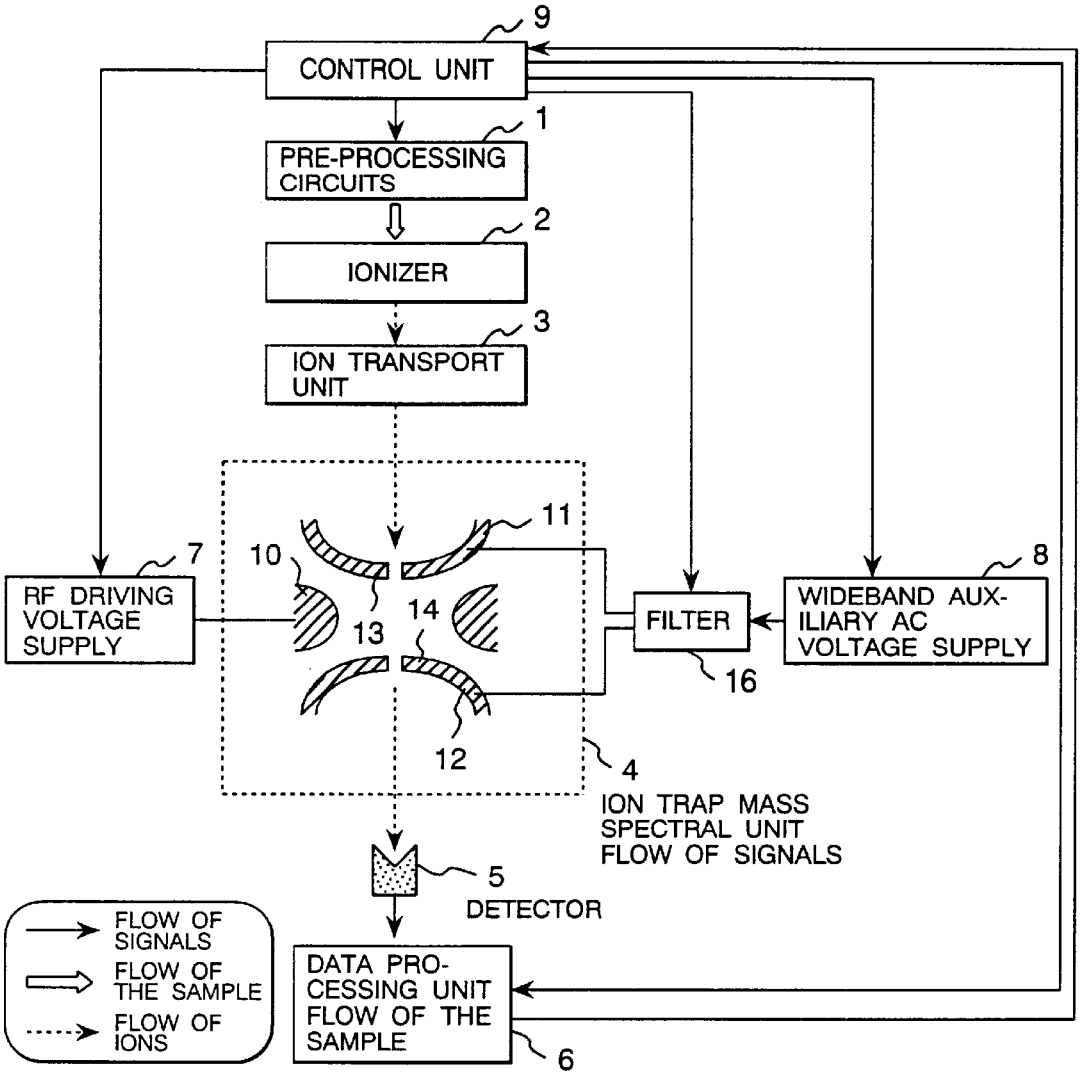
FIG. 22 is a total schematic diagram of the ion trap mass spectrometer described in embodiment 8.

Embodiment 8 is described below using FIG. 22. In this embodiment, as shown in FIG. 22, the wideband auxiliary AC voltages that have been developed by wideband auxiliary AC voltage supply 8 are controlled by control unit 9 so that, when passed through filter 16 these voltages will be the same as the wideband auxiliary AC voltages shown in each heretofore-described embodiment by filtering the wideband auxiliary AC voltages by filter 16. At this time, complex control during the generation of the wideband auxiliary AC voltages is avoided and this facilitates the internal control operation of control unit 9.

According to this embodiment, therefore, relatively easy control by control unit 9 enables the creation of such wideband auxiliary AC voltages as shown in each heretofore-described embodiment, highly efficient release of undesired ions, and high-resolution mass separation of the desired ions and undesired ions.

According to the present invention, it becomes possible to eject undesired ions very efficiently and to separate the desired ions and undesired ions at high resolution, by optimizing the wideband auxiliary AC voltage, comprising plural frequency components, according to the amplitude value of the RF driving voltage and/or the particular frequency of each frequency component of the wideband auxiliary AC voltage. Ease in the operations of the apparatus also improves since the wideband auxiliary AC voltage can be optimized automatically.

What is claimed is:

1. An ion trap type mass spectrometer comprising:

a ring electrode;

a pair of end cap electrodes arranged facing one another so as to arrange said ring electrode between said end cap electrodes;

a radio-frequency power supply for applying to said ring electrode and said end cap electrodes a radio-frequency voltage that generates a radio-frequency electric field in the space formed between said ring electrode and said end cap electrodes;

an ion generator for creating ions inside said inter-electrode space or creating ions outside said space and introducing the ions thereinto, a trapper for trapping created ions in said inter-electrode space where said radio frequency electric field is formed, an alternating-current (AC) electric field generator for generating in said space a wideband auxiliary AC electric fields which comprise plural different frequency components, the frequency range of which are corresponding to the mass-to-charge ratio range of undesired ions to eject the undesired ion is by resonant ejection; and a detector for sequentially separating the ions trapped in said space in terms of mass according to the particular mass-to-charge ratio of the ion and detecting the mass of these ions after the trapped ions have been emitted from said space;

an electric field changer varying the strength of wideband auxiliary AC electric fields comprising the frequency components within the required frequency range according to the strength of the radio-frequency electric field generated in said space.

2. An ion trap type mass spectrometer set forth in claim 1, wherein said electric field changer is set so that as the maximum strength of the radio-frequency electric field generated in said space increases, the maximum strength of said wideband auxiliary AC electric fields increase.

3. An ion trap type mass spectrometer set forth in claim 1, wherein said electric field changer is set so that as the maximum strength of the radio-frequency electric field generated in said space increases, the maximum strength of said wideband auxiliary AC electrode fields also increase and wherein the maximum strength of said wideband auxiliary AC electric fields is increased in proportion to the maximum strength of the radio-frequency electric field within said inter-electrode space.

4. An ion trap type mass spectrometer set forth in claim 1, wherein said electric field changer varies said wideband auxiliary AC electric fields according to the amplitude value of the radio-frequency voltage applied between said ring electrode and said end cap electrodes.

5. An ion trap type mass spectrometer set forth in claim 1, wherein said electric field changer varies the strength of said wideband auxiliary AC electric fields according to the mass-to-charge ratio of the ion to be left in the space.

6. An ion trap type mass spectrometer set forth in claim 1, wherein said electric field changer varies the strength of said wideband auxiliary AC electric fields according to the mass-to-charge ratio of the ion existing when a specific frequency within the frequency range of said wideband auxiliary AC voltage becomes equal to the main oscillation frequency of said ion's oscillation between said ring electrode and said end cap electrodes.

7. An ion trap type mass spectrometer set forth in claim 1, wherein said electric field changer varies the value of said wideband auxiliary AC voltages according to the strength level of the radio-frequency electric field.

8. An ion trap type mass spectrometer set forth in claim 1, wherein said electric field changer varies the amplitude values of individual auxiliary AC voltages of the different frequencies within the required frequency range according to the particular frequencies of each frequency component at said wideband auxiliary AC voltages.

9. An ion trap type mass spectrometer set froth in claim 8, wherein said electrode field changer varies the amplitude values of individual auxiliary AC voltages of the different frequencies within the required frequency range according to the particular frequencies of each frequency component at said wideband auxiliary AC voltages; and wherein said electric field changer is set so that the amplitudes of each frequency component at said wideband auxiliary AC voltages having frequencies close to those within the range of the main oscillation frequency of the ion to be left in the space will be equal to, or less than, the amplitudes of individual auxiliary AC voltages of frequency components having frequencies which are far from those within the range of the main oscillation frequency of said ion to be left.

10. An ion trap type mass spectrometer set forth in claim 7, wherein the changer for changing the wideband auxiliary AC voltages consisting of the interspaced different frequency components within the required frequency range varies said wideband auxiliary AC voltages according to the particular relationship between the oscillation frequency range, in said inter-electrode space, of the to-be-ejected ion having a mass-to-charge ratio within the required range, and the frequency range of said wideband auxiliary AC voltages.

11. An ion trap type mass spectrometer set forth in claim 10, wherein the changer for changing said wideband auxiliary AC voltages according to the particular relationship between the oscillation frequency range, in said space, of the to-be-ejected ion having a mass-to-charge ratio within the required range, and the frequency range of said wideband auxiliary AC voltages, is set so that the amplitude values of said wideband auxiliary AC voltages existing when the oscillation frequency range of the to-be-ejected ion mentioned above oversteps the frequency range of said wideband auxiliary AC voltages will exceed the amplitude values obtained when the oscillation frequency range of the to-be-ejected ion mentioned above does not overstep the frequency range of said wideband auxiliary AC voltages.

12. An ion trap type mass spectrometer set forth in claim 1, wherein said AC electric field generator applies said wideband auxiliary AC electric fields during ionization when ions are created in the space, or during the injection of ions into the space when the ions are created outside the space.

13. An ion trap type mass spectrometer comprising:

a ring electrode;

a pair of end cap electrodes arranged facing one another so as to arrange said ring electrode between said end cap electrodes, a radio-frequency power supply for applying to said ring electrode and said end cap electrodes a radio-frequency voltage that generates a radio-frequency electric field in the space formed between said ring electrode and said end cap electrodes, an ion generator for creating ions inside said inter-electrode space or creating ions outside said space and introducing the ions thereinto, a trapper for trapping created ions in said inter-electrode space where said radio frequency electric field is formed, an alternating-current (AC) electric field generator for generating in said space wideband auxiliary AC electric fields which comprise plural different frequency components, the frequency range of which are corresponding to the mass-to-change ratio range of undesired ions to eject the undesired ions by resonant ejection; and a detector for sequentially separating the ions trapped in said space in terms of mass according to the particular mass-to-charge ratio of the ion and detecting the mass of these ions after the trapped ions have been emitted from said space;

an electric field changer for varying the strength of wideband auxiliary AC electric fields comprising the frequency components within the required frequency range according to the strength of the radio-frequency electric field generated in said space;

wherein said electric field varies said wideband auxiliary AC voltages according to the strength level of the radio-frequency electric field generated in said inter-electrode space;

wherein said electric field varies the amplitude values of individual auxiliary AC voltages of the different frequencies within the required frequency range according to the particular frequencies of each frequency component at said wideband auxiliary AC voltages; and wherein the amplitude values of the auxiliary AC voltages of frequency components having frequencies near the ends of the required frequency range of said auxiliary AC voltages are set to be equal to, or less than, the amplitudes of said auxiliary AC voltages of frequency components having the frequencies corresponding to the median region of the required frequency range.

14. An ion trap mass spectrometer comprising:

a ring electrode;

a pair of end cap electrodes arranged facing one another so as to arrange said ring electrode between said end cap electrodes, a radio-frequency power supply for applying to said ring electrode and said end cap electrodes a radio-frequency voltage that generates a radio-frequency electric field in the space formed between said ring electrode and end cap electrodes, an ion generator for creating ions inside said inter-electrode space or creating ions outside said space and introducing the ions thereinto, a trapper for trapping created ions in said inter-electrode space where said radio frequency electric field is formed, an alternating current (AC) electric field generator for generating in said space a wideband auxiliary AC electric fields which comprise plural different frequency components, the frequency range of which are corresponding to the mass-to-change ratio range of undesired ions to eject the undesired ions by resonant ejection; and a detector for sequentially separating the ions trapped in said space in terms of mass according to the particular mass-to-charge ratio of the ion and detecting the mass of these ions after the trapped ions have been emitted from said space;

the strength of wideband auxiliary AC electric fields comprising the frequency components within the required frequency range is varied according to the strength of the radio-frequency electric field generated in said space;

wherein the changer for changing the strength of said wideband auxiliary AC electric fields according to the strength of the radio-frequency electric field generated in said space applies, between said ring electrode and end cap electrodes, wideband auxiliary AC voltages comprising the different frequency components within the required frequency range, and varies said wideband auxiliary AC voltages according to the strength level of the radio-frequency electric field generated in said inter-electrode space, and wherein the change for changing the wideband auxiliary AC voltages consisting of the different frequency components within the required frequency range varies the differences of frequency between the adjoining frequency components of each auxiliary AC voltage of the different frequencies within the required frequency range according to the frequencies of each frequency component at said wideband auxiliary AC voltages.

15. An ion trap type mass spectrometer set forth in claim 14, wherein the changer for changing the differences between the adjoining frequency components of each auxiliary AC voltage of the interspaced different frequencies within the required frequency range according to the frequencies of each frequency component at said wideband auxiliary AC voltages is set so that within the required frequency range of wideband auxiliary AC voltages, the frequency differences between the adjoining frequencies of each frequency component at said wideband auxiliary AC voltage in a radio-frequency region will exceed the frequency differences between the adjoining frequencies of each frequency component at said wideband auxiliary AC voltage in a low-frequency region.

16. An ion trap type mass spectrometer set forth in claim 14, wherein the changer for changing the frequency differences between the adjoining frequency components of wideband auxiliary AC voltage of the different frequencies within the required frequency range according to the frequencies of each frequency component at said wideband auxiliary AC voltages is set so that as the mass-to-charge ratio of an ion having its primary oscillation frequency which is equal to the frequency of one of the components decreases, the frequency difference between the adjoining frequency components of a wideband auxiliary AC voltage will increase.

* * * * *